US009240311B2

(12) United States Patent
Whitehouse et al.

(10) Patent No.: US 9,240,311 B2
(45) Date of Patent: Jan. 19, 2016

(54) APPARATUS FOR ANALYSIS OF SAMPLE CHEMICAL SPECIES FEATURING MULTIPLE SAMPLE PLACEMENT LOCATIONS

(75) Inventors: Craig M. Whitehouse, Branford, CT (US); Thomas Dresch, East Syracuse, NY (US)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

(21) Appl. No.: 13/487,037

(22) Filed: Jun. 1, 2012

(65) Prior Publication Data

US 2012/0312980 A1 Dec. 13, 2012

Related U.S. Application Data

(60) Provisional application No. 61/493,255, filed on Jun. 3, 2011.

(51) Int. Cl.

| | |
|---|---|
| ***H01J 49/00*** | (2006.01) |
| ***H01J 49/14*** | (2006.01) |
| ***H01J 49/04*** | (2006.01) |
| ***H01J 49/24*** | (2006.01) |

(52) U.S. Cl.

CPC ..... *H01J 49/145* (2013.01); *H01J 49/0413* (2013.01); *H01J 49/0431* (2013.01); *H01J 49/0459* (2013.01); *H01J 49/24* (2013.01)

(58) Field of Classification Search

CPC ..... H01J 49/00; H01J 49/02; H01J 49/0459; H01J 49/0431; H01J 49/0422; H01J 49/0468; H01J 49/165; H01J 49/167; H01J 49/168; H01J 49/18; H01J 49/0063

USPC ..... 250/281, 282, 285, 288, 289

See application file for complete search history.

(56) References Cited

U.S. PATENT DOCUMENTS

| | | | | |
|---|---|---|---|---|
| 4,542,293 | A | 9/1985 | Fenn et al. | |
| 4,766,313 | A * | 8/1988 | Homma et al. | 250/289 |
| 5,184,016 | A * | 2/1993 | Ronan et al. | 250/288 |
| 5,528,032 | A * | 6/1996 | Uchiyama | 250/288 |
| 5,726,447 | A * | 3/1998 | Aisawa et al. | 250/288 |
| 5,753,910 | A | 5/1998 | Gourley et al. | |

(Continued)

OTHER PUBLICATIONS

Authorized Officer L. Young. International Search Report and Written Opinion in International Application No. PCT/US2012/040587, dated Oct. 22, 2012, 9 pages.

(Continued)

*Primary Examiner* — Nicole Ippolito
*Assistant Examiner* — Jason McCormack
(74) *Attorney, Agent, or Firm* — Fish & Richardson P.C.

(57) ABSTRACT

A Direct Sample Analysis (DSA) ion source system operating at essentially atmospheric pressure is configured to facilitate the ionization, or desorption and ionization, of sample species from a wide variety of gaseous, liquid, and/or solid samples, for chemical analysis by mass spectrometry or other gas phase ion detectors. The DSA system includes one or more means of ionizing samples and includes a sealed enclosure which provides protection from high voltages and hazardous vapors, and in which the local background gas environment may be monitored and well-controlled. The DSA system is configured to accommodate single or multiple samples at any one time, and provide external control of individual sample positioning, sample conditioning, sample heating, positional sensing, and temperature measurement.

28 Claims, 25 Drawing Sheets

(56) References Cited

U.S. PATENT DOCUMENTS

| | | | | |
|---|---|---|---|---|
| 5,959,297 | A | 9/1999 | Weinberg et al. | |
| 6,573,494 | B1 * | 6/2003 | Andrien et al. | 250/288 |
| 7,982,185 | B2 | 7/2011 | Whitehouse et al. | |
| 2003/0168586 | A1 * | 9/2003 | Yamaguchi et al. | 250/281 |
| 2004/0021071 | A1 * | 2/2004 | Mordekhay | 250/288 |
| 2004/0099803 | A1 | 5/2004 | Tong et al. | |
| 2004/0217281 | A1 * | 11/2004 | Bai et al. | 250/288 |
| 2004/0217283 | A1 * | 11/2004 | Bai et al. | 250/288 |
| 2005/0199823 | A1 * | 9/2005 | Franzen | 250/425 |
| 2006/0255261 | A1 * | 11/2006 | Whitehouse et al. | 250/288 |
| 2007/0228271 | A1 * | 10/2007 | Truche et al. | 250/288 |
| 2008/0067348 | A1 | 3/2008 | Musselman | |
| 2009/0057550 | A1 * | 3/2009 | Stults et al. | 250/282 |
| 2009/0095899 | A1 * | 4/2009 | Whitehouse et al. | 250/282 |
| 2009/0294660 | A1 * | 12/2009 | Whitehouse et al. | 250/288 |
| 2010/0096542 | A1 | 4/2010 | Whitehouse et al. | |
| 2011/0031392 | A1 | 2/2011 | McEwen et al. | |
| 2011/0121173 | A1 | 5/2011 | Koenig et al. | |
| 2011/0198495 | A1 * | 8/2011 | Hiraoka | 250/282 |

OTHER PUBLICATIONS

Liang et al., "Alternately Pulsed Nano-electrospray Ionization/Atmospheric Pressure Chemical Ionization for Ion/Ion Reactions in an Electrodynamic Ion Trap," *Analy. Chem.*, 2006, 78(9):3208-3212.

Van Berkel GJ et al., "Established and emerging atmospheric pressure surface sampling/ionization techniques for mass spectrometry," *J. Mass Spectrom.*, 2008, 43:1161-1180.

Venter et al., "Ambient desorption ionization mass spectrometry," *Trends in Analy. Chem.*, 2008, 27:284-290.

European Search Report in Application No. 12792541.0, dated Feb. 17, 2015, 10 pages.

Office Action in AU Application No. 2012261885, issued Jun. 30, 2015, 3 pages.

Office Action issued in CN201280036911.9 on Jul. 31, 2015 with English Translation (22 pages).

* cited by examiner

Negative Ion Mode

APPARATUS FOR ANALYSIS OF SAMPLE CHEMICAL SPECIES FEATURING MULTIPLE SAMPLE PLACEMENT LOCATIONS

CROSS-REFERENCE TO RELATED APPLICATIONS

This application claims benefit of Provisional Application No. 61/493,255, filed on Jun. 3, 2011, the entire contents of which are incorporated herein by reference.

TECHNICAL FIELD

The disclosure relates to Direct Sample Analysis systems that include ion sources that operate at atmospheric pressure and are interfaced to a mass spectrometer or other gas phase detectors. The ion sources can generate ions from multiple samples having widely diverse properties, the samples being introduced directly into the Direct Sample Analysis system ion sources.

BACKGROUND

There has been a rapid growth in recent years in the prevalence and variety of techniques for the desorption and ionization of sample species from solid surfaces at ambient atmospheric conditions, without significant sample preparation, followed by chemical analysis by mass spectrometry. Examples of such techniques include, but are not limited to: "desorption electrospray ionization" (DESI); "thermal desorption atmospheric pressure chemical ionization" (TD/APCI); "direct analysis in real time" (DART); "desorption atmospheric pressure chemical ionization" (DAPCI); and "laser desorption/electrospray ionization" (LD/ESI). Recent reviews that enumerate and elucidate such techniques are provided by: Van Berkel G J, et. al., "Established and emerging atmospheric pressure surface sampling/ionization techniques for mass spectrometry", J. Mass Spectrom. 2008, 43, 1161-1180; and, Venter A., et al., "Ambient desorption ionization mass spectrometry", Trends in Analytical Chemistry, 2008, 27, 284-290.

Most such techniques have been demonstrated with ion source configurations that were open to the environment. Open configurations are attractive because they can allow easy optimization of analysis conditions, such as sample positioning and reagent source positioning, easy sample treatment during analysis, such as heating or cooling, and a straightforward exchange of samples. However, open ion source configurations may exhibit serious deficiencies with respect to safety concerns which preclude their use in unregulated facilities, and are inadvisable elsewhere for the same reasons. For example, open source configurations may not provide adequate protection for the operator from accidental exposure to the high voltages and/or elevated temperatures typically employed in such sources. Open sources may also fail to contain vaporized sample and reagent material which is often very toxic.

Apart from such safety concerns, ion sources operating at atmospheric pressure often rely on chemical reactions involving gaseous species that are present naturally in the local ambient, such as water vapor, oxygen, and/or nitrogen. As such, the performance of such sources may vary significantly as the local concentration of such reactants drifts uncontrollably, resulting in degraded performance and/or poor reproducibility. There is a significant need for a direct sample analysis system that provides real-time monitoring, feedback, conditioning and control of sample background and ionization conditions.

To date, only a few attempts are known to have been made to configure such atmospheric pressure ion sources with an enclosure that provides for safe operation, and the ability to better control and manipulate the ambient environment. However, such attempts to outfit ambient atmosphere ion sources with an enclosure have at the same time compromised some of the more advantageous features of open ion sources, such as: the ability to readily optimize the position of samples, as well as the positions of various desorption and/or ionization components, for maximum ionization efficiency and transport of ions into vacuum during operation; to readily access a sample surface, for example, to monitor the surface temperature, or to visualize the surface appearance; and the ability to configure mechanisms that allow multiple samples to be loaded into a source at the same time; and, hence, to provide for the possibility of automated operation. Therefore, there has been a need for ambient pressure ion sources that are configured with an enclosure that provides operator protection and ambient environment control, while also providing for these advantageous features otherwise available with open ambient ion sources.

Additionally, prior ambient atmosphere ion sources have been configured to accommodate only a single type of solid, liquid, or gaseous samples. Hence, there is a need for an ambient atmosphere ion source that is able to accommodate one or more samples of one or more sample types in a relatively compact space, without requiring substantial reconfiguration or operator intervention. Furthermore, there has been a need for enclosed ambient atmosphere ion sources that provide automated identification and automated optimization of the position, and orientation of samples and auxiliary components, such as desorption and/or ionization probes.

SUMMARY

The disclosure relates to embodiments of Direct Sample Analysis (DSA) systems that include sample ionization means that operates at atmospheric pressure and allows the direct introduction of a single sample or multiple samples. These samples may vary in homogeneity and states of matter including but not limited to gas, liquid, solid, emulsions, and mixed phases. The DSA ion source system is interfaced to a mass spectrometer or other gas phase detectors, such as an ion mobility analyzer, that analyzes the mass-to-charge or mobility of ions produced in the ion source from sample species. The DSA ion source system is configured to generate sample related ions from samples introduced directly into the DSA ion source system enclosure at or near atmospheric pressure. In some embodiments, the ion source includes at least a subset of the following elements:

1. a means to load and hold single or multiple samples, for example, a sample holder assembly having removable grid sample holders,
2. a means to move and position each sample to optimize analysis of each single or multiple sample, for example, a multi-axis (e.g., four axis) translator assembly having one or more linear and rotational degrees of freedom, or various linkage or gear assemblies,
3. a means to introduce one or more gas, liquid or solid or variable property samples automatically while minimizing introduction of contamination into the ion source,
4. a means to sense the type, size, physical features and position of each sample introduced, for example, a position sensor, 5. a means to automatically identify sample holder types, for example, laser distance sensors,
6. a means to monitor and eliminate unwanted background or contamination species, for example, a countercurrent gas flow, a mass spectrometer,
7. a means to dry or condition the sample surface prior to analysis, for example, a heat source,
8. a means to heat the sample to dry and/or form sample related gas phase molecules, for example, a light source,
9. a means for sensing the temperature of the sample surface, for example, pyrometers and thermocouples,
10. a means to generate reagent ions, electrons, excited state neutral molecules (metastable species) or charged droplets to facilitate ionization of sample-related molecules, for example, a glow charge,
11. an angled reagent ion generator that enables the introduction and analysis of multiple samples positioned on a variety of sample holder types and shapes without mechanical or heat interference,
12. an angled reagent ion generator that includes a rotating exit end with exchangeable exit channels to maximize sample ionization and ion sampling efficiency,
13. a reagent ion generator that includes multiple gas inlets a liquid inlet with pneumatic nebulization of introduced liquid,
14. a means to manually or automatically position the reagent ion or electrospray charged droplet generation means to provide optimal performance, for example, position sensors used in conjunction with translator assemblies,
15. a means to direct sample related ions generated at atmospheric pressure into a mass spectrometer operating in vacuum for mass-to-charge analysis, for example, voltages applied to electrodes and ion optics,
16. an enclosure surrounding the ion source and loaded sample holder that isolates the ionization region and loaded sample from the ambient environment outside the enclosure,
17. a means to automatically control the sample holder, sensing, movement, purging, ionization and mass spectrometric or ion mobility analysis of sample related ions while the DSA system enclosure is sealed, for example, control software that include automated tuning algorithms,
18. other embodiments that generate sample related ions based on one or more of electrospray, atmospheric pressure chemical ionization (APCI), photoionization and laser ionization methods, and
19. a moisture sensor to measure the moisture content in the purge gas.

In some embodiments, the Direct Sample Analysis ion source simultaneously includes means to introduce one or more gas samples or one or more solid or liquid samples. For example, these means include one or more gas inlets and liquid inlets. Gas samples can be ionized directly in a corona discharge region or through charge exchange with gas phase reagent ions. Solid or liquid samples introduced into the ion source are evaporated and ionized through charge exchange with corona discharge generated reagent ions; charge exchange or ionization through collisions with electrospray generated ions or charged droplets; or with photoionization. In addition, sample solution can be introduced directly into the reagent ion generator where the solution is nebulized, vaporized and ionized as it passes through the corona discharge region.

The means to hold single or multiple solid, liquid or multiphase samples includes sample holders of different shapes and configurations to accommodate variations in shape, type, compositions and size of sample analyzed. The sample holder is positioned on an automated translation stage that moves the sample holder into and through ion source enclosure. In some embodiments, the sample holder translator includes a four axis motion controller with two axes of rotation and two linear motion axes. Round shaft seals are provided for three axes of motion, providing an efficient but low friction seal between the ion source interior and the ambient environment outside the ion source. One linear motion axis is fully contained within the ion source enclosure, eliminating the need for a linear seal from the external environment. The sample translator assembly within the ion source enclosure includes materials that are chemically inert and do not produce chemical contamination that can contribute unwanted chemical noise or interference ions in acquired mass spectra.

In some embodiments, the sample translator is configured to enable loading and unloading of solid or liquid phase samples through a door that is sealed when closed and minimizes the introduction of ambient contamination when open. Sequencing of clean purging gas flow through the ion source sealed enclosure minimizes the introduction of ambient contamination when loading and unloading sample holders. The gas purging also helps to reduce cross contamination between sequential samples when generating ions in the sealed enclosure. When loading and unloading solid and liquid samples the purge gas is controlled to minimize exposure to the user of samples volatilized inside the sealed ion source enclosure. The purging of background contamination species process can be monitored directly using the mass spectrometer or with additional sensors such as a moisture sensor at the outlet vent of the purge gas. In this manner of monitoring, with data dependent feedback to the control system, optimal and reproducible conditions for analysis can be achieved after loading samples, drying samples or between sample analysis to avoid carryover from sample to sample.

The disclosure includes systems having one or more position sensors to determine zero positions of the sample translator, the number of samples loaded, the shape and size of each sample and the position of each sample surface from which ions are to be generated. The zero position sensors are configured to establish the home or zero position of each axis of sample translation. In some embodiments, laser distance sensors, for example, interferometers, are configured to identify the holder type and map the sample holder surface contour, so that, once samples are loaded, a determination may be made as to which sample positions are filled, the size of each loaded sample and the position of each sample surface. Information provided by the distance sensors is processed by the software and electronics control system to enable optimal placement of each sample for maximum ion generation and mass spectrometer sampling efficiency, avoid collisions between the samples with any surface in the ion source enclosure (particularly for large or irregularly shaped samples), locate or move the reagent ion generator to its optimal position and determine the most efficient motion sequences of the sample holders for multiple sample analysis.

Precise translational control of the sample position provides a number of advantages when using both position sensing and mass spectrometric or ion mobility signal response to feedback and optimize. Using both the exact position of the surface and mass spectrometric or ion mobility signal response allows the acquisition of more uniform and accurate analytical results; particularly for samples having widely varying sizes, surface shapes, topography and properties, such as melting point. Optimum ionization and ion collection geometries can be obtained that are independent of sample-to-sample size and surface variations. In addition, nonhomogeneous sample surfaces can be positionally manipulated to analyze specific surface features. Surface analysis can be conducted with good spatial resolution by heating the surface with focused light or lasers beams. Video sensing of the surface topography can also be implemented to chemically interrogate surface features (e.g. spots on tablets).

For many liquid or solid samples, heat is required to vaporize the sample for gas phase ionization. Gas samples may also require heat to prevent sample condensation. Embodiments include means for generating heat in several different ways, including: delivering heated gas though the reagent ion generator; heating the counter current drying gas; heating using infrared, white or laser light sources; and direct sample heating through the sample holder. The total enthalpy delivered is controlled through gas heater temperature and gas flow, light or laser intensity, direct heater wattage or combinations of multiple heat sources. Enthalpy is a measure of the total energy of a system. In some embodiments, the ion source includes a means to measure the temperature of samples to provide feedback temperature control. Such feedback improves the uniformity and reproducibility of sample ionization. Examples of means to measure the temperature of samples include temperature sensors such as thermocouples and pyrometers. Thermocouples provide direct temperature feedback for gases and samples in contact with thermocouple sensors. Pyrometer sensors configured in the ion source measure temperature of a solid or liquid sample surfaces from which evaporating sample molecules are released. Precise temperature measurement and feedback control enables stepwise conditioning of the sample during analysis by applying serial thermal processes including temperature ramps, drying (unbound water), dehydrating (bound water), analyte evaporation, which is subsequently ionized, and ultimately, stages of pyrolysis or thermal decomposition that may provide structural information about the sample.

The disclosure describes multiple means to generate reagent species for ionizing sample molecules via metastable ionization, electron transfer, charge exchange or ion-molecule reactions. Examples of these means include glow discharges. Due to the sealed ion source enclosure during sample analysis, the background gas composition can be controlled to provide optimal ionization conditions. In particular, the amount of water vapor in the ion source enclosure can be controlled to efficiently generate protonated water while minimizing protonated water clusters. The disclosure features apparatus having multiple gas inlets and a liquid inlet with nebulization in the reagent ion generator. Single or multiple combinations of liquid or gas phase species can be introduced and ionized in the heated reagent ion generator. The reagent ion generator heater vaporizes nebulized liquids and some or all vapor and gas pass through a corona discharge region positioned near the reagent ion generator exit end. The corona discharge is positioned inside the reagent ion generator, which minimizes distortion of electric fields applied to direct sample ions into the mass spectrometer. Sample solution can be directly introduced into the reagent ion generator for nebulization, evaporation and ionization through Atmospheric Pressure Chemical Ionization (APCI) charge exchange reactions. In some embodiments, the vaporized liquid sample passes directly through the corona discharge region for maximum ionization efficiency.

In one example application, water can be completely removed from the ionization region and samples with lower proton affinity than water can be analyzed. Chemical ionization reagents such as methane or ammonia can be introduced to provide higher degrees of selectivity when compared to traditional APCI sources. A wide variety of reagent chemistries can be implemented with this DSA ion source system.

In some embodiments, the reagent ion generator, and in some applications the APCI sample ion generator, has an angled geometry. In some embodiments, the axis of the nebulizer and vaporizer is configured at an angle to the axis of the generator exit channel. The apparatus can include an angled exit channel configured to rotate at least 180°, which enables optimal positioning of the reagent ion generator body and exit channel, thereby maximizing analytical performance while minimizing interference with multiple sample holders. The exit channel is removable to allow the installation of optimized exit channel geometries for various sample types. The angled geometry allows the optimization of the position and angle of the reagent ion generator exit relative to sample types and relative to the mass spectrometer inlet orifice, while preventing the body of the reagent ion generator from interfering with samples and the sample holder. The angled geometry also moves the reagent ion generator heater away from the sample holder to avoid preheating of samples prior to ionization, thereby minimizing, cross-contamination between samples. In some embodiments, the reagent ion generator is positioned entirely within the Direct Analysis Source, which avoids the need for any seals in the enclosure wall except for those seals required for gas and liquid flow lines. The reagent ion generator includes materials that minimize contributions to background chemical noise in acquired mass spectra.

Depending on the sample type and geometry, the reagent ion generator exit plane and axis requires position adjustment to maximize ionization efficiency and ion transport into the mass spectrometer. In some embodiments, the reagent ion generator is mounted to a four axis translation assembly to allow a wide range of position adjustment within the DSA source enclosure. The reagent ion generator position can be set manually or automatically with position sensor feedback to the DSA source control software and electronics. In some embodiments, the reagent ion generator position can be set automatically by software and electronics, based on the distance sensor profiling of the sample holder type and sample types introduced into the ion source enclosure. Different diameter and geometry size exit sections can be exchanged on the reagent ion generator to maximize ionization efficiency for different sample types, size and species. The reagent ion generator is configured with a replaceable corona discharge needle assembly. Removal of the angled exit end facilitates removal and installation of the corona or glow discharge needle assembly.

A portion of the sample ions generated by different methods in the ion source chamber are directed toward the entrance orifice into vacuum and subsequently into the mass spectrometer where they are mass to charge analyzed. Alternatively, ions generated in the DSA source are directed into a mobility analyzer. In some embodiments of the DSA source, electric fields are applied to one or more electrodes to direct ions through an orifice into vacuum against a counter current gas flow. The counter current gas flow serves to minimize or prevent undesired neutral species (particles and molecules) from entering the vacuum, thereby minimizing or eliminating neutral species condensation with sample ions in the free jet expansion, and eliminating neutral species contamination on electrode surfaces. The electric fields and electrode geometries are optimized to maximize DSA ion source mass spectrometer sensitivity. The DSA source enclosure minimizes and/or prevents any exposure of high voltage or electric fields to the user. The mapping of sample holder types and sample positions using position sensors, to constrain sample holder and reagent ion generator translation within the ion source, minimizes and/or prevents unwanted contact with electrode surfaces by samples or moving ion source hardware during sample analysis.

The disclosure features apparatus that include a sealed enclosure which reduces and/or prevents ambient contamination from entering the ion source volume. Such ambient species can unpredictably affect ionization of sample species or contribute to unwanted interference or chemical background noise in the mass spectra. The enclosure allows tighter control of the reagent ion species generated in the ion source volume, enabling maximum and reproducible ionization efficiency and higher ionization specificity for a given sample species.

Purge gas flow is configured to sweep the ion source of gas phase sample molecules to reduce the time required between sample analysis and to minimize cross contamination between samples. Purge gas exits through a vent port where it is exhausted through a safe laboratory vent system. The sealed enclosure with safe gas purging minimizes and/or prevents exposure to the user of volatilized sample species. In some embodiments, the ion source vent, through which the reagent ion generator gas flow, the counter current gas flow and the purge gas flow exit, is positioned above the sample loading plate in the sample loading region. Gas flow into the DSA source chamber flows by the sample loading plate during sample loading, reducing and/or preventing ambient gas contamination from entering the ion source while the sample loading door is open. When the sample loading door is closed, gas flowing over and above the sample loading plate and out the vent serves to purge the sample loading volume of ambient gas prior to moving the samples into the DSA source volume. This purge process in the sample loading region can also be used to dry the newly loaded sample if this is desirable for a given sample type. A moisture or humidity sensor positioned in the vent port or line provides feedback to control systems and software regarding the degree of dryness achieved prior to moving the newly loaded samples into the DSA source volume. Measuring the degree of dryness of each sample loaded provides a way to improve consistency in the moisture remaining (or not remaining) in the sample, which can provide improved consistency in multiple sample analysis. Samples prepared on different days can be conditioned in the DSA system to improve the uniformity of analytical results for the same sample types. For example, the same type of medicinal pills prepared and run on different days can be dried consistently prior to analysis to improve the uniformity of the sample pill surface being analyzed.

The sealed enclosure is removable to facilitate ion source cleaning In some embodiments, the enclosure includes an access door that is sealed when closed. The access door and enclosure have safety sensors that turn off voltages and heaters when the DSA source enclosure seal is broken.

In some embodiments of the DSA source, sample holder translation and reagent ion generator translation can be operated in fully automated mode or with selective manual position adjustment. The position sensor inputs to the software enable the software and electronics control system to set constraints on the sample holder and reagent ion generator translation to prevent hardware collisions or electrical shorting in either automated or manual translation operation. Ion source control systems are linked to sample lists to provide correlation between generated mass spectrometer data and sample positions on multiple sample holders.

Some embodiments include the capability for software-controlled x-y-z translation of the sample and recording of the sample spot position, which enables spatial scanning during mass spectra acquisition. For example, the sample analysis spot can track sample separation lines on thin layer chromatography traces of sample mixtures.

The disclosure also encompasses DSA system control software that provides specific ionization method information per sample to the mass spectrometer data evaluation software to optimize data evaluation of acquired data and report generation. Data dependent feedback can be applied to the DSA system control software to adjust sample ionization conditions to improve performance.

The disclosure features single or multiple means of ionizing samples. Ionization means include but are not limited to reagent ion and charged droplet generation using electrospray, Atmospheric Pressure Chemical Ionization, photoionization, corona discharge and glow discharge employed singularly or in combination. Sample ionization means include but are not limited to charged droplet absorption and ion generation from evaporating charged droplets, gas phase charge exchange or energy exchange reactions, chemical ionization, photoionization and laser ionization individually or operating with combinations of ionization types.

The DSA System can be used to analyze many states of matter including but not limited to solids, liquids, gases, emulsions, powders, heterogeneous and multiphase samples and mixtures thereof.

DESCRIPTION OF DRAWINGS

Like reference symbols in the various drawings indicate like elements.

DETAILED DESCRIPTION

Open ion sources configured for direct analysis of samples are subjected to variations in the composition of background air and expose the end user to the sample being analyzed and any reagent species being deployed in the analysis. Gaseous reagent species and volatilized sample material can be inhaled by end users running the analysis. This exposure can be particularly dangerous when analyzing drugs, newly synthesized compounds, medicinal samples, diseased tissue, toxic materials or even unknown samples as in forensic samples with no available history. When operating open ion sources, changes in the background gas composition can affect ionization efficiency, contribute background contamination, add interfering component peaks to mass spectra, change reagent ion composition and temperature unpredictably, leading to unpredictable analytical results. The disclosure features apparatus and methods that allow the analysis of multiple samples directly introduced into an enclosed ion source volume with precisely monitored and controlled background gas composition, temperature and flow. Reagent ion generation in a DSA ion source system is tightly controlled and reproducible, increasing sample analysis robustness and reproducibility. Unlike open ion sources where users are potentially exposed to any voltages applied to electrodes, the DSA ion source system includes the application of electric fields formed from voltages applied to electrodes configured within the enclosed ion source volume. These applied electric fields direct ions through an orifice into vacuum, thereby increasing mass spectrometer analytical sensitivity.

Commercially available open ion sources typically use neutral gas flow to pull sample generated ions into vacuum. This same gas flow also entrains non-ionized contamination molecules and sweeps these unwanted species into vacuum where they can condense on sample ions or contaminate mass spectrometer electrodes in vacuum. The disclosure features apparatus and methods that include a counter current gas flow for sweeping away unwanted neutral contamination species from entering vacuum while directing sample ions through the orifice into vacuum using focusing electric fields. The DSA ion source system includes a dielectric capillary which allows separation of the entrance and exit ends, both electrically and spatially. This electrical electrode isolation allows different voltages to be applied to the capillary entrance and exit electrodes simultaneously, thereby providing optimal voltages both in the atmospheric pressure ion source and the in vacuum regions, as described in U.S. Pat. No. 4,542,293. Electrostatic focusing of ions at atmospheric pressure enables efficient sampling of ions into vacuum against a counter current drying gas, increasing sensitivity while decreasing unwanted neutral contamination gas or vapor molecules from entering vacuum.

Figure 1:
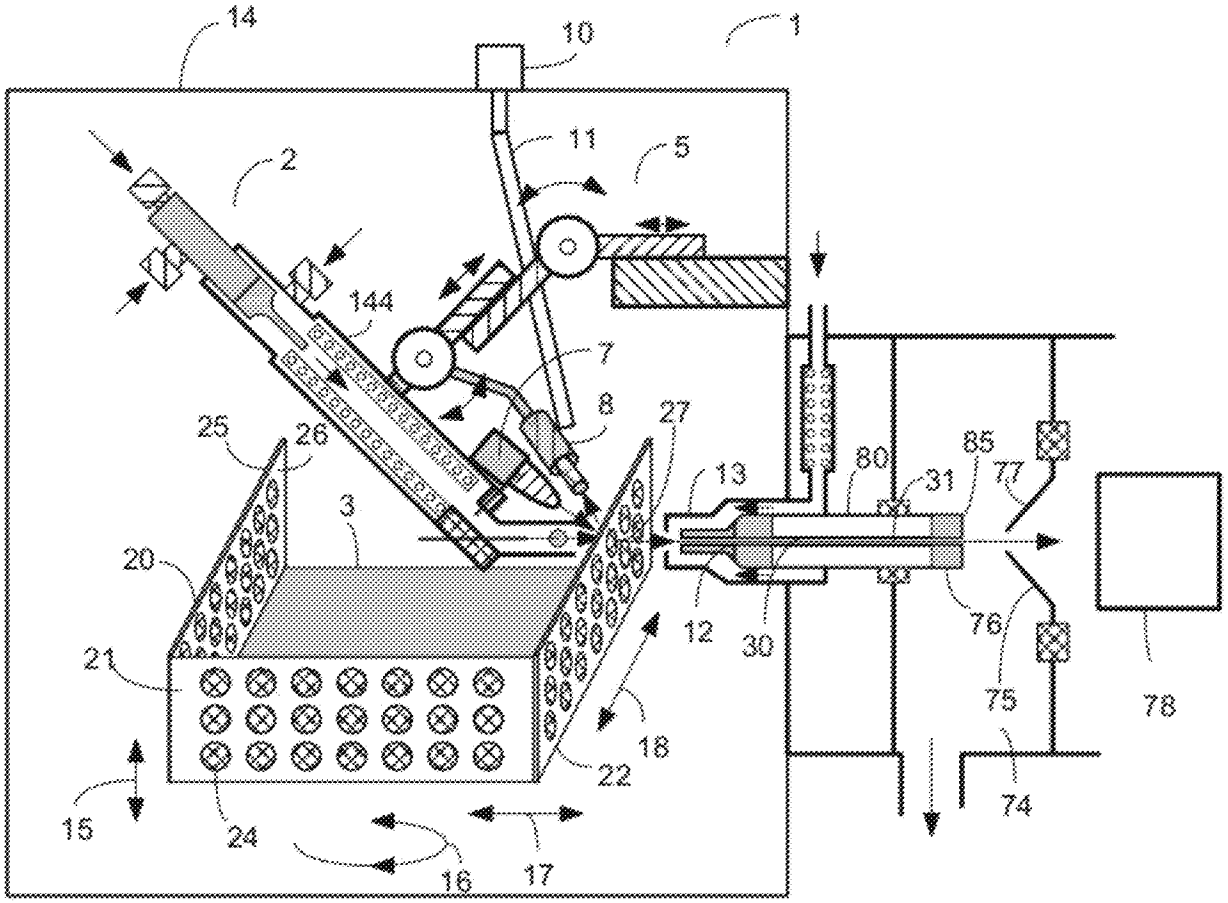
FIG. 1 is a diagram of an embodiment of a Direct Sample Analysis (DSA) ion source and system that includes a position-translatable reagent ion generator and square shaped sample holder, multiple hole screen sample targets and a capillary orifice into a mass spectrometer.
Figure 2:
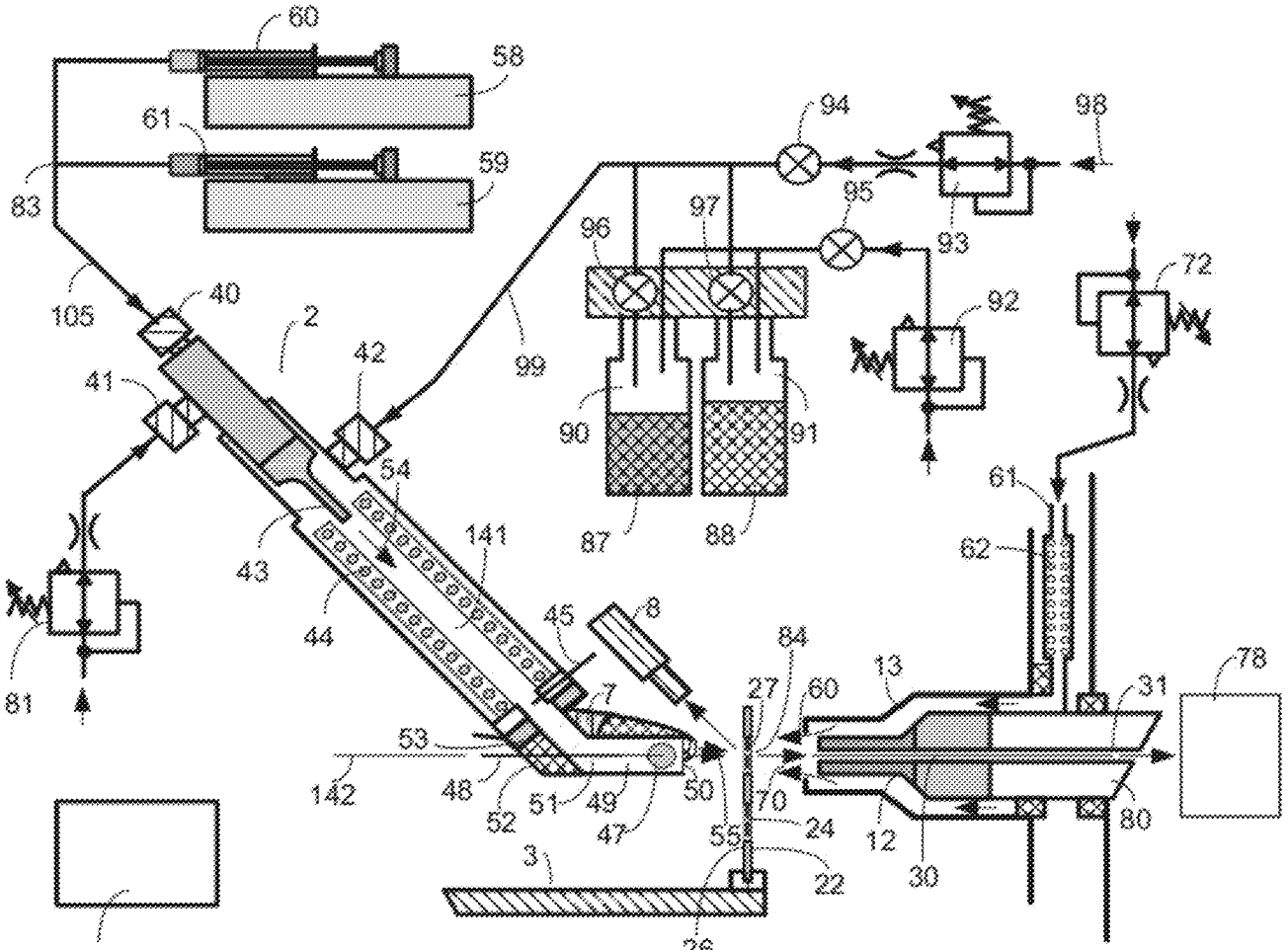
FIG. 2 is a diagram of an embodiment of gas and liquid introduction means into a DSA source reagent ion generator and counter current drying gas heater configured with a mesh sample holder.

Referring to FIGS. 1 and 2, a DSA ion source system 1 includes a reagent ion generator assembly 2, a sample holder assembly 3 with removable grid sample holders 20, 21 and 22, a reagent ion generator translator assembly 5, a light heater 7, a pyrometer 8, a video camera 10 with fiber optic and focusing lens input 11, a mass spectrometer capillary entrance electrode 12, a nose piece electrode assembly 13, and an enclosure assembly 14. Sample holder assembly 3 includes three removable sample holders 20, 21 and 22 each with 21 individual sample placement locations as diagrammed. Sample holder assembly 3 supports between one to four removable sample holders. Sample holders 20, 21 and 22 include a mesh 24, typically stainless steel or a porous polymer, on which a liquid sample is loaded. Mesh 24 is sandwiched between metal plates 25 and 26 for support and mounting. Sample holder assembly 3 is positioned via a four axis translator assembly 180 shown in FIGS. 8, 9, 10 and 11. A translator assembly 180 includes two linear and two rotational degrees of translation movement that effect Y vertical 15, rotational 16, Z horizontal 17 and X horizontal 18 axis movement of sample holder assembly 3.

As shown in FIG. 1 and in more detail in FIG. 2, reagent ion generator 2 includes a liquid inlet 40, a nebulizer gas inlet 41, an auxiliary gas inlet 42, a pneumatic nebulizer 43, a heater 44, a thermocouple 45, a corona discharge needle 48 mounted through an electrical insulator 52 and an angled exit channel 49. Single component or mixtures of liquids delivered through liquid inlet 40 are nebulized in pneumatic nebulizer 43 with gas flowing through nebulizer inlet 41. Nebulized liquid and carrier gas 54 is evaporated and heated as it passes through heater 44. The temperature of the gas and vapor mixture exiting heater 44 is measured using thermocouple 45 which is fed back to the control software and electronics to regulate the heater temperature. Heated gas flows through angled exit channel 49 surrounded by removable end piece 51 and passes through corona or glow discharge 47. Corona or glow discharge 47 is formed by applying typically positive or negative polarity kilovolt potentials on corona or glow discharge needle 48 while exit end piece 51 remains at ground or zero volt potential. Positive polarity voltage applied to corona or glow discharge needle 48 produces positive polarity reagent ions. Negative polarity reagent ions are produced by applying negative polarity voltage to corona or glow discharge needle 48. Heated reagent ions are formed in corona discharge 47. Heated reagent ions and carrier gas pass through reagent ion generator exit 50 and move toward a sample 27 contained on grid 24 of sample holder 22. Alternatively, a glow discharge 47 produces ions or energetic metastable atoms or molecules which interact with the reagent gas and the sample to form regent and sample ions.

Nebulization gas inlet 41 is connected to nebulization gas pressure regulator or flow controller 81, which controls the nebulizing gas flow rate through nebulizer 43. Nebulizing gas pressure regulator 81 is connected to and controlled through the DSA ion source system electronics and software control system 82. Nebulizing gas composition is typically but not limited to nitrogen or dry purified air. Liquid inlet 40 is connected to syringe pumps 58 and 59 loaded with syringes 60 and 61 respectively. Syringe pumps 58 and 59 can be run separately to deliver individual liquid species with controlled flow rate or can be run simultaneously to generate a mixed liquid compositions flow or form gradients of liquid compositions entering reagent ion generator 2. Alternatively, syringe pumps 58 and 59 can be replaced with any fluid delivery systems known in the art such as a liquid chromatography pump or pressurized liquid holding vials. For many sample types, a desirable positive polarity reagent ion is hydronium or protonated water $(H_3O)^+$ because hydronium has a very low proton affinity and will readily charge exchange in the gas phase with any molecule having a higher proton affinity. Protonated water clusters are less desirable because the proton affinity of water clusters grows with the number of water molecules in the cluster. Consequently, protonated water clusters can remove protons from protonated sample ions in the gas phase, reducing sample ion sensitivity. Due to the closed environment of the DSA source ionization region, the percentage of water in the background reagent gas can be tightly controlled to maximize hydronium ion production while minimizing protonated water clusters.

The percentage of water in the gas flowing through exit channel 49 is determined by the flow rate of water flowing through liquid inlet 40, which is nebulized in pneumatic nebulizer 43, and the total flow of nebulizer gas and auxiliary gas flowing through gas inlets 41 and 42, respectively. For example, with one liter per minute of nebulizer gas flowing through inlet 41, and syringe pump 58 delivering a one microliter per minute flow rate of water to nebulizer 43, after vaporization of water, which results in approximately a 1000× expansion in volume, water vapor would have a concentration of approximately 0.1% by volume flowing through exit channel 49 and corona or glow discharge 47. The percentage of water in this reagent ion gas flow can be accurately adjusted by changing the flow rate delivered by syringe 58 or the gas flow rates passing through gas inlets 41 and 42. Corona or glow discharge 47 ionizes the nitrogen gas molecules flowing through it, which in turn forms hydronium ions through a series of gas phase reactions known to those skilled in the art. The heated reagent ion gas exiting reagent ion generator exit channel 49 at exit 50 flows through grid 24, evaporating sample deposited at sample spot 27. The evaporated sample molecules charge exchange with hydronium ions and form protonated sample ions, if the sample molecules have a higher proton affinity than the passing hydronium ions. Sample ions will be formed in region 84 downstream of sample spot 27. Formed sample ions then follow the focusing electric field lines formed by voltages applied to nose piece electrode 13 and capillary entrance electrode 12 and the grounded or zero volt sample holder 22. Driven by the electric field, sample ions move against dry nitrogen counter current gas flow 60. Counter current gas flow 60 carries away any neutral water molecules or water clusters and dries protonated water clusters moving with the electric field, thereby reducing and/or preventing neutral water clusters from removing charge from the newly formed sample ions, and eliminating neutral molecules of sample or water from entering vacuum. Ions and neutral nitrogen gas enter vacuum through the rapidly cooling free jet expansion formed at exit end 85 of capillary orifice 30 in capillary 80 with little or no neutral molecule condensation occurring on sample ions. The DSA ion source system configured according to the disclosure provides accurate control of reagent ion production and delivery, enabling robust, consistent and reproducible analytical operation. As is desired, the sample itself is the one variable being analyzed, because of the reproducible controls and conditions surrounding the sample during operation.

Samples with low proton affinity in the case of positive ions may be ionized using reagent ion composition different from water. For example, a sample molecule may not accept a proton from a hydronium ion if it does not have protonation sites, but may form an attachment with a protonated ammonia ion to form a sample ion with an attached ammonia ion. Such gas phase reactions are known in the field of Atmospheric Pressure Chemical Ionization (APCI) and vacuum Chemical Ionization (CI). Ammonia can be delivered into reagent ion generator 2 in liquid form using syringe pump 58 or 59 as was described for water above, or ammonia can be drawn off as head space gas 90 or 91 in vials 87 or 88 respectively. Flow control of head space gas from vials 87 and 88 is provided by pressure regulator 92 and valve 95. Head space gas flow from either one or both vials 87 and 88 can be selected by opening or closing valves 96 and 97 respectively. Head space gas 90 or 91 flows through connection 99 and inlet 42 into heater 44. Alternatively, different auxiliary gas flow species 98 can be introduced into reagent ion generator 2 through inlet 42. Auxiliary gas flow 98, controlled through gas flow controller 93 and valve 94, may be supplied from a pressurized gas tank. For example, it may be desirable to introduce helium as a reagent gas because ionized and metastable helium formed in corona or glow discharge 47 has a high ionization potential, which improves charge transfer efficiency when these helium metastable or ion species collide with a gas phase atom or molecule. Helium is a relatively expensive gas and may not be needed to ionize many sample species. Helium can be mixed with nitrogen or other gases to form a reagent ion mixture. Valves 94, 95, 96 and 97, pressure regulators 92 and gas flow controller 93 are connected to DSA source electronics and software controller 82 to provide software and automated control of some or all gas and liquid flows into reagent ion generator 2. Alternatively, the auxiliary gas composition and flow can be controlled manually.

As shown in FIGS. 1 and 2, syringe or fluid delivery pumps 58 and 59 and fluid tee 83 are positioned outside of DSA ion source system 1 sealed enclosure assembly 14. Similarly, reagent solution vials 87 and 88 with accompanying valves 94 through 97, pressure regulator 92 and flow controller 93 are positioned outside sealed enclosure assembly 14, as is electronics controller module 82. Only inert materials that do not contribute significantly to background chemical noise in mass spectra or effect ionization efficiency of gas phase sample molecules are configured inside sealed enclosure assembly 14 of DSA ion source system 1. Materials configured inside sealed enclosure assembly 14 are typically but not limited to metal, ceramic or glass. Fluid or gas flow channels are connected to sealed feed throughs which pass through enclosure assembly 14. Wires to heater 44, thermocouple 45 and electrodes or Electrospray needles positioned within enclosure assembly 14 are typically electrically insulated with ceramic insulators. Electrical insulators inside sealed DSA ion source enclosure assembly 14 may include other materials than ceramic provided such materials do not degas to the extent that such degassing interferes with sample ionization or to the extent that such degassing results in interference peaks or chemical noise in the acquired mass spectra.

Reagent ion generator 2 can alternatively be operated as an Atmospheric Pressure Chemical Ionization probe in which a sample is ionized directly. With sample holder assembly 3 moved away from the region 84 between reagent ion generator exit 50 and nose piece entrance 70, ions generated in corona discharge 47 can be delivered directly to capillary orifice 30, driven by applied electric fields as described above. Effectively, the reagent ion generator 2 can be operated as a field-free APCI inlet probe, as described in U.S. Pat. No. 7,982,185. For example, gas samples from a gas chromatograph can be delivered through inlet 40 directly into heater 44 to avoid sample component condensation. The gas chromatography carrier gas is typically helium which provides efficient ionization of the eluting gas samples as they pass through corona or glow discharge 47. Alternatively, gas samples can be introduced into reagent ion generator inlets 41 or 42 allowing the introduction of additional reagent ion species in parallel to maximize ionization efficiency. Liquid samples can also be introduced through inlet 40 from liquid chromatographs, injection valves or other fluid flow systems known to those in the art. For example, calibration solution, flow injected from syringe 58 through 40, is nebulized in pneumatic nebulizer 43, vaporized as the nebulized droplets pass through heater 44 and ionized as the calibration vapor passes through corona or glow discharge 47. The calibration ions directed into mass spectrometer 78 through capillary orifice 30 can be used to tune and calibrate mass spectrometer 78. In a similar manner, such calibration ions can also be added during sample 27, or any other sample, ionization to provide internal standard calibration ions for accurate mass measurements in higher resolving power mass spectrometers. Mass spectrometer 78 may be, but is not limited to, a quadrupole, triple quadrupole, Time-Of-Flight (TOF), Hybrid Quadrupole Time-Of-Flight, Orbitrap, Hybrid Quadrupole Orbitrap, 2D or 3D Ion Trap, Time-Of-Flight—Time-Of-Flight or Fourier Transform type mass spectrometer.

Referring to FIGS. 1 and 2, counter current gas 61 initially passes through counter current gas heater 62, exiting at nose piece exit 70. Counter current gas flow rate is controlled through flow regulator 72 connected to software and electronics controller 82. Voltages are applied to capillary entrance electrode 12 and nose piece electrode 13 to direct sample ions into capillary orifice 30, which move against counter current drying gas 60. Carrier gas expanding into vacuum sweeps entrained ions into vacuum stage 74. Voltages are applied to capillary exit electrode 76 and skimmer electrode 75 to direct ions exiting capillary orifice 31 into mass spectrometer 78 for mass to charge analysis. Counter current gas flow 60, typically, but not limited to nitrogen or dry air, sweeps away unwanted neutral contamination molecules, preventing neutral contamination species from entering vacuum. Countercurrent gas flow 60 eliminates or minimizes condensation of contamination molecules on sample ions in the free jet expansion into vacuum and minimizes unwanted neutral molecule contamination of electrodes in vacuum. Capillary entrance electrode 12 and exit electrode 76 are separated spatially and electrically. Different voltage values can be simultaneously and independently optimized for capillary entrance electrode 12 and exit electrode 13 as is described in U.S. Pat. No. 4,542,293. For example, voltage values applied to nose piece 13, capillary entrance electrode 12 and capillary exit electrode 76 may be set to −300 VDC, −800 VDC and +120 VDC respectively for positive ion polarity generation during DSA ion source operation. An ion focusing electric field formed from the voltages applied to nose piece electrode 13 and capillary entrance 12 directs sample ions formed near grounded sample target 27 into capillary orifice 30. Gas flowing through capillary orifice 30 pushes ions through capillary orifice 30 against a decelerating electric field between capillary entrance and exit electrodes 12 and 76 respectively. Ions exit capillary orifice 31 at approximately the electrical potential applied to capillary exit electrode 76 plus the velocity imparted by the seeded molecular beam. Voltage of the capillary exit electrode 76 can be increased relative to the voltage applied to skimmer 75 to selectively cause fragmentation of ions without changing the electric field in sample ionization region 84. Fragmentation of ions can be helpful in establishing compound identification or to determine compound structure.

Figure 3:
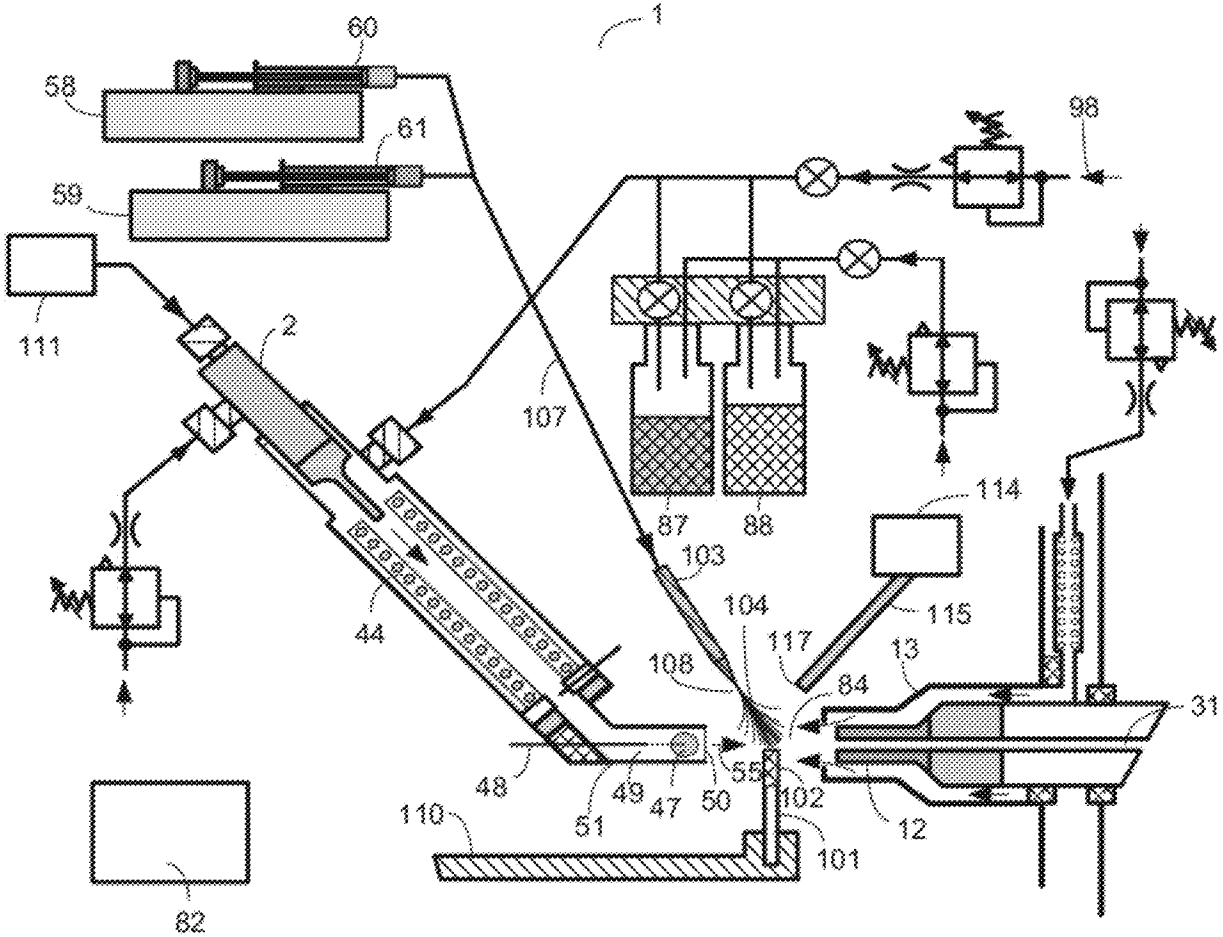
FIG. 3 is cross section view of an embodiment of a reagent ion generator and a capillary orifice into vacuum with an electrospray charge droplet source that includes gas and liquid supplies and interconnections.

Referring to FIG. 3, DSA ion source system 1 can be configured with addition sources of reagent ions or charged droplets to enhance sample ionization efficiency. DSA ion source system 1 includes Electrospray needle 103 mounted inside enclosure 14. Liquid delivered from one or more fluid delivery systems or syringe pumps 58 and 59 with syringes 60 and 61 respectively, supply reagent liquid or sample solution through fluid line 107 into Electrospray needle 103. Reagent liquid or sample solution is electrosprayed from tip 108 of electrospray needle 103 to form a plume of charged droplets 104. Electrospray plume 104 is formed by the applied voltage difference between Electrospray needle 103 and nose piece electrode 13 or grounded exit channel 49 wall 110. In some embodiments, a high voltage power supply is connected to electrospray needle 103 and the voltage set to a value that will sustain a stable electrospray plume. Alternatively, sufficient voltage can be applied to nose piece electrode 13 to provide a stable electrospray with electrospray needle 103 maintained at ground potential. Applying voltage to both electrospray needle 103 and nose piece 13 typically can be used to optimize sample ionization efficiency and ion sampling into mass spectrometer 78.

Sample molecules are evaporated from sample 102 due to heated reagent gas and ions 55 exiting from reagent ion generator exit 50 impinging on sample tube 101. Sample 102 is deposited on and/or loaded in glass tube 101 mounted on sample holder 110. Evaporated sample molecules may be absorbed into the electrosprayed charged liquid droplets. Sample ions are then formed as the charged liquid droplets evaporate, moving toward nose piece electrode orifice 70 against heated counter current drying gas 60, forming ions as the charged droplet evaporation proceeds, as is known in the art. Alternatively, reagent ions possibly with multiple charges formed from evaporating electrospray droplets can charge exchange with gas phase sample molecules to form sample ions that are then directed into capillary orifice 30 and on to mass spectrometer 78 for mass to charge analysis as described above. Gas phase sample molecules from sample 102 can be exposed to reagent ions 55 exiting reagent ion generator 2 or electrospray generated reagent ions or charged droplets individually or simultaneously. Selection of reagent ion or charged droplet sources is achieved by controlling voltages applied to corona or glow discharge needle 48 and electrospray needle 103 and by controlling fluid flow or nebulization and reagent gas sources 111, 58, 59, 87, 88 and 98.

Sample gas may be introduced directly into ionization region 84 where ionization occurs through charge exchange with reagent ions or metastable species formed from corona or glow discharge 47 or electrospray 103 sources. Resulting sample ions are then directed into mass spectrometer 78 for mass to charge analysis as described above. Referring to FIG. 3, sample gas supply 114, delivers sample gas through gas flow tube 115 with sample gas exiting at end 117 proximal to ionization region 84. Sample gas supply 114 can be but not limited to a gas chromatograph, an ambient gas sampler or breathalyzer, positioned outside of sealed enclosure assembly 14.

Sample heating is an important variable to control to achieve reproducible, consistent and reliable sample ionization efficiencies. Different samples have different heat capacities and may require different temperatures to effect sample molecule evaporation. In some embodiments, the enthalpy required to heat a sample surface can be controllably delivered from multiple sources. One source of heat applied to a sample surface is delivered as heated reagent ion gas from reagent ion generator 2 as described above. The amount of enthalpy delivered to a sample surface from reagent ion and gas flow 55 exiting exit 50 of reagent ion generator 2 is a function of exiting gas and ion mixture 55 temperature and flow rate. Gas and reagent ion temperature is controlled by setting the temperature of heater 44 with some addition of heat from corona or glow discharge 47. Total gas flow rate passing through reagent ion generator 2 exit 50 is described above. Alternatively, or in addition, heat can also be delivered to a sample surface using a light source.

Figure 4:
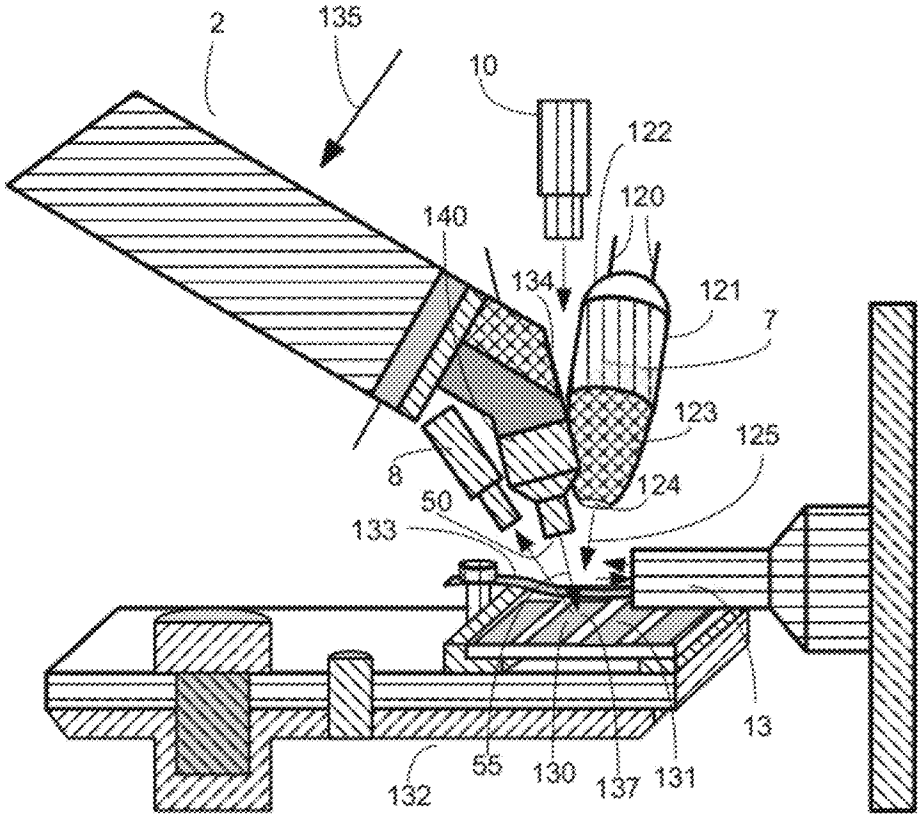
FIG. 4 is a close up of a thin layer chromatography sample target in a DSA system that includes the reagent ion generator exit configured in an angled down position, focused light source heating and pyrometer temperature feedback.

Referring to FIGS. 1, 2, 4 and 5, light source 7 includes, but is not limited to, an infrared light source, a white light source or a laser which, as shown in FIG. 4, includes electrical contacts 120. Some embodiments of heating light source 7 include an infrared or white light quartz bulb configured in reflective envelope 121. Top end 122 of internally reflective envelope 121 includes an approximate parabolic reflector and exit end 123, shaped internally as an internally reflective light concentrator as is known in the solar collector field. Heating light source exit 124 may include a light focusing lens, an open aperture, or an internally reflective light pipe, depending on the sample and analytical requirements. Heating light source 7 is mounted and positioned in DSA ion source system 1 so that light 125 exiting from heating light source 7 is aimed at the sample being analyzed. The light intensity impinging on the sample surface is adjusted by controlling the voltage applied to light bulb electrodes 120, or the laser power if light source 7 is a laser, and the size of the focused light spot. Light and heated reagent gas can be used individually or simultaneously to controllably heat a sample surface. Depending on the sample type and composition, controlled heating or heat gradients applied to a sample surface that includes a mixture of components can cause a separation in time or temperature of different sample components leaving the sample surface. Compound species with lower evaporation temperatures evaporate from the sample surface prior to higher evaporation temperature sample species. Ramping the sample surface temperature through a temperature gradient can achieve a separation of sample components in time. This temperature separation of sample species may reduce interferences in the ionization process, increase analytical peak capacity and allow some degree of selectivity with ion fragmentation in the capillary to skimmer region. Additional analytical information is also obtained about the sample surface composition by monitoring the desorption of species as a function of temperature in a fashion well known to those skilled in the art of thermal desorption spectroscopy.

Figure 5:
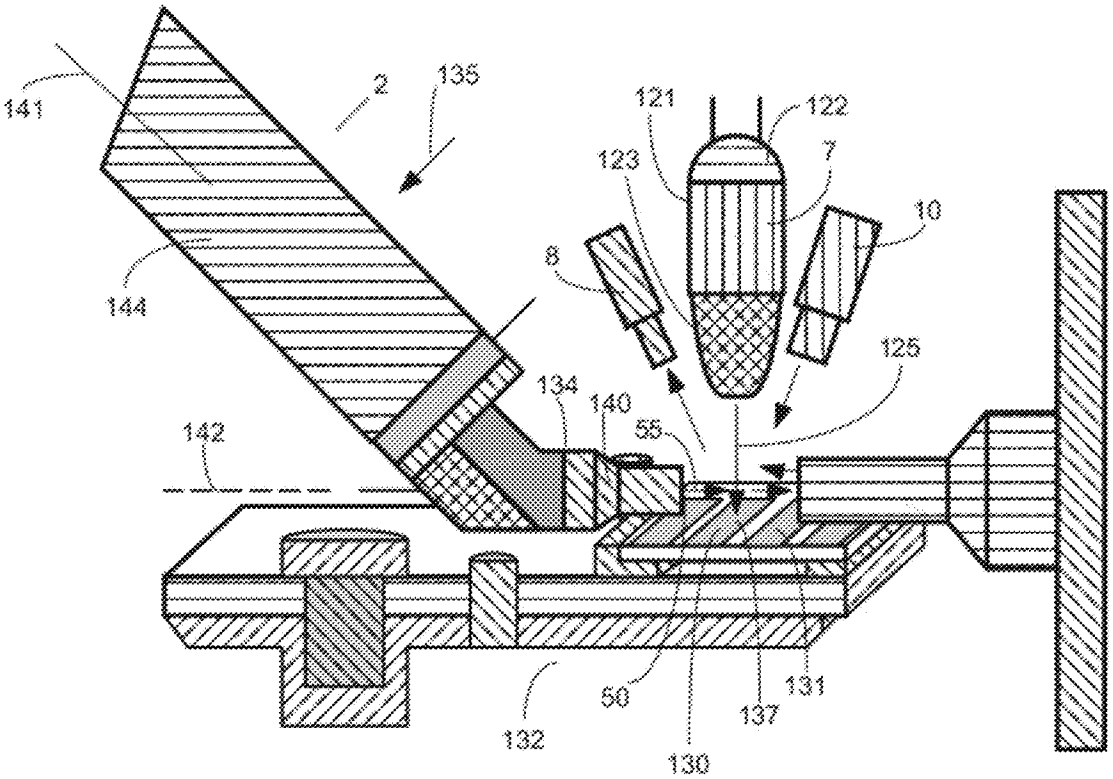
FIG. 5 is a close up of a thin layer chromatography sample target in a DSA ion source that includes the reagent ion generator exit configured in the horizontal position, focused light source heating and pyrometer temperature feedback.

Heating light source 7 can be configured with an exit lens which focuses the emitting light to a smaller spot on a sample surface than can be achieved using heated gas flow. This focused source of heat allows improved spatial resolution on surfaces when analyzing solid phase samples or other sample types. Referring to FIGS. 4 and 5, thin layer chromatography (TLC) plates 130 and 131 are mounted on sample holder assembly 132 and held in place by spring clip 133. A mixture of sample species are separated along the length of a thin layer chromatography plate resulting in a line of spatially separated sold phase sample components. Thin layer chromatography plates 130 and 131, as mounted on sample holder assembly 132, have sample separation lines running approximately perpendicular to the axis of nose piece 13. One or more rows of sample separation may be run on a single TLC plate. To avoid cross talk between TLC channels on the same plate, focused application of heat is required with minimal overheating. Focused heating light 124 is directed at one channel of TLC separated sample as sample holder assembly 132 moves TLC plate 130 line in a direction perpendicular to the axis of nose piece electrode 13. Pyrometer 8 aimed at heated sample spot 137 on TLC plate 130 measures the surface temperature being directly heated by heating light 125. The pyrometer 8 temperature measurement is fed back to the control software to adjust the light intensity of heating light source 8 to maintain the sample surface temperature at sample location 137 at the desired set temperature. When heating light source 7 includes an infrared light source, the lamp can be turned off briefly when taking a pyrometer measurement to avoid an error in the surface temperature reading due to the infrared light. Sample surface temperature can be measured directly with pyrometer 8, or alternatively with a thermocouple. Direct measurement of sample surface temperature with feedback to the heater controls enables more consistent, reliable and robust ion source performance when analyzing multiple samples of the same sample type, when analyzing sample surfaces such as TLC plates or plant or animal tissue or when measuring different sample types.

The intensity of heating light or laser 8 can be rapidly adjusted because it is not subject to the heat capacity of a heater element as is the case with reagent ion generator heater 44. Adjustment of the gas temperature of reagent gas 55 exiting exit channel 49 takes a longer time due to the heat capacity of the total gas flow path in reagent ion generator 2 and to the heat generated by corona or glow discharge 47. FIG. 4 shows reagent ion generator 2 configured and positioned with angled exit end 134 directing gas and ion flow flowing through exit 50 directly toward sample spot 137. Heated gas and ions 50 impinging on sample surface location 137 supplement the more focused heat delivered to sample surface 137. Referring to FIG. 5, reagent ion generator 2 and angled exit end 134 are rotated approximately 180° and moved down along angled axis 135. Gas and reagent ions 50 flowing through exit 50 are directed approximately parallel to sample surface location 137. In the embodiment shown in FIG. 5, light heater 7 delivers the primary source of enthalpy delivered to sample surface location 137, allowing tighter control of sample surface temperature and the size of the area being heated at sample location 137. In the embodiments shown in FIGS. 4 and 5, pyrometer 8 is positioned to read the temperature of sample location 137 being heated.

DSA ion source system 1 can be configured with video camera 10 with or without fiber optic probe 11. Video camera 10 with correct positioning can be used to view the sample surface location being analyzed and feed back to software or the user the visual status of the surface at any time during the analysis. The four axis sample holder assembly 3 translator control determines the precise location of a given sample surface relative to mass spectrometer 78 capillary sampling orifice 30. The known sample position is correlated to acquired mass spectral data and can also be correlated to video images during sample analysis. Video camera 10 includes appropriate light optics lenses to provide magnification of sample surfaces. With the appropriate optics, video camera 10 can be configured outside enclosure 14 to minimize exposure of video camera 10 to the sample environment and to reduce and/or eliminate any degassing of the camera enclosure or electronics. Such degassing would add undesirable background chemical species inside enclosure 14 of the DSA ion source system 1.

Angled reagent ion generator 2 shown in FIGS. 1 through 7 includes rotatable angled end 134 with removable end piece 51 in shown FIGS. 1, 2, 3, 6 and 7 and rotatable reduced diameter end piece 140 shown in FIGS. 4 and 5. Referring to FIGS. 2 and 5, reagent ion generator heater axis 141 is angled from exit end 134 axis 142. The angle reagent ion generator geometry allows the analysis of round, square or other shaped sample holder assemblies where samples can be loaded along the entire outside edge without interfering with reagent ion generator 2. For example, in FIG. 1 sample holders 20, 21 and 22 are mounted along the outside edge of square shaped sample target assembly 3. As each sample 27 is moved into position for analysis, no contact is made with reagent ion generator 2 by any other samples mounted to sample holder assembly 3. The angled reagent ion generator 2 geometry positions insulated heater body 144 sufficiently far away from loaded samples to avoid unwanted sample heating prior to or subsequent to each sample analysis. Due to the angled geometry of reagent ion generator 2 and the four axis translation of sample holder 3, a large number of samples having different shapes and sizes can be positioned and analyzed using a compact geometry of sample holder assembly 3. For example, the perimeter of a six inch square sample holder assembly is twenty four inches long. An equivalent linear geometry sample holder would be 24 inches long in one direction but an ion source 48 inches wide would be required to pass some or all samples in a line past ionization region 84. The more compact geometry of sample holder assembly 3 with samples mounted arranged in three dimensions instead of two dimensions allows the configuration of a smaller and more compact DSA ion source 1 and a correspondingly smaller enclosure 14.

A smaller DSA ion source 1 and enclosure 14 volume includes less volume to purge of gas phase contaminants between each sample analysis and when loading and unloading of sample holder assemblies 3 110, 132 and 162. Less gas usage is required to effectively purge a smaller source volume and less time is required to remove contamination gas species prior to starting a new sample analysis set or between each sample analyzed. Faster purging of contaminant species allows faster analysis times for multiple sample sets improving overall ion source analytical efficiency.

Figure 6:
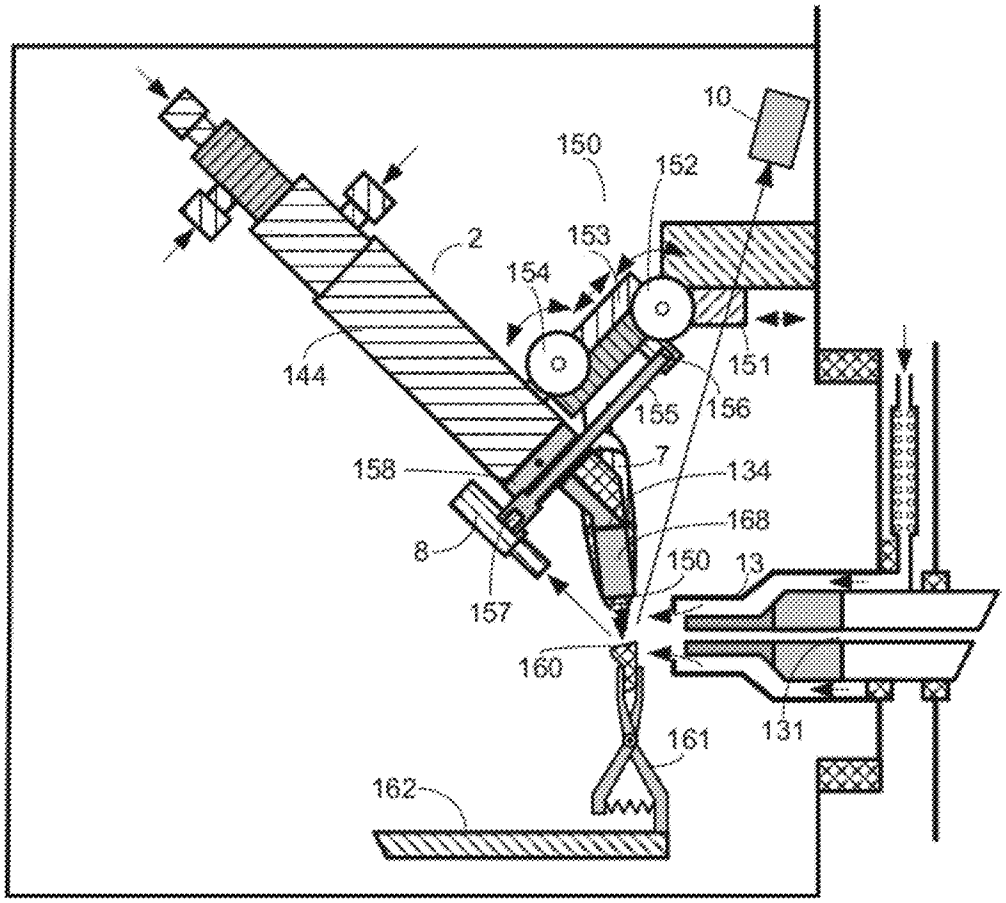
FIG. 6 is a diagram of an embodiment of a DSA ion source system that includes a multiple axis reagent ion generator position translator with a reagent ion generator exit configured in an angled down position, a pyrometer temperature sensor feedback, a video monitor and a spring clip sample holder.
Figure 7:
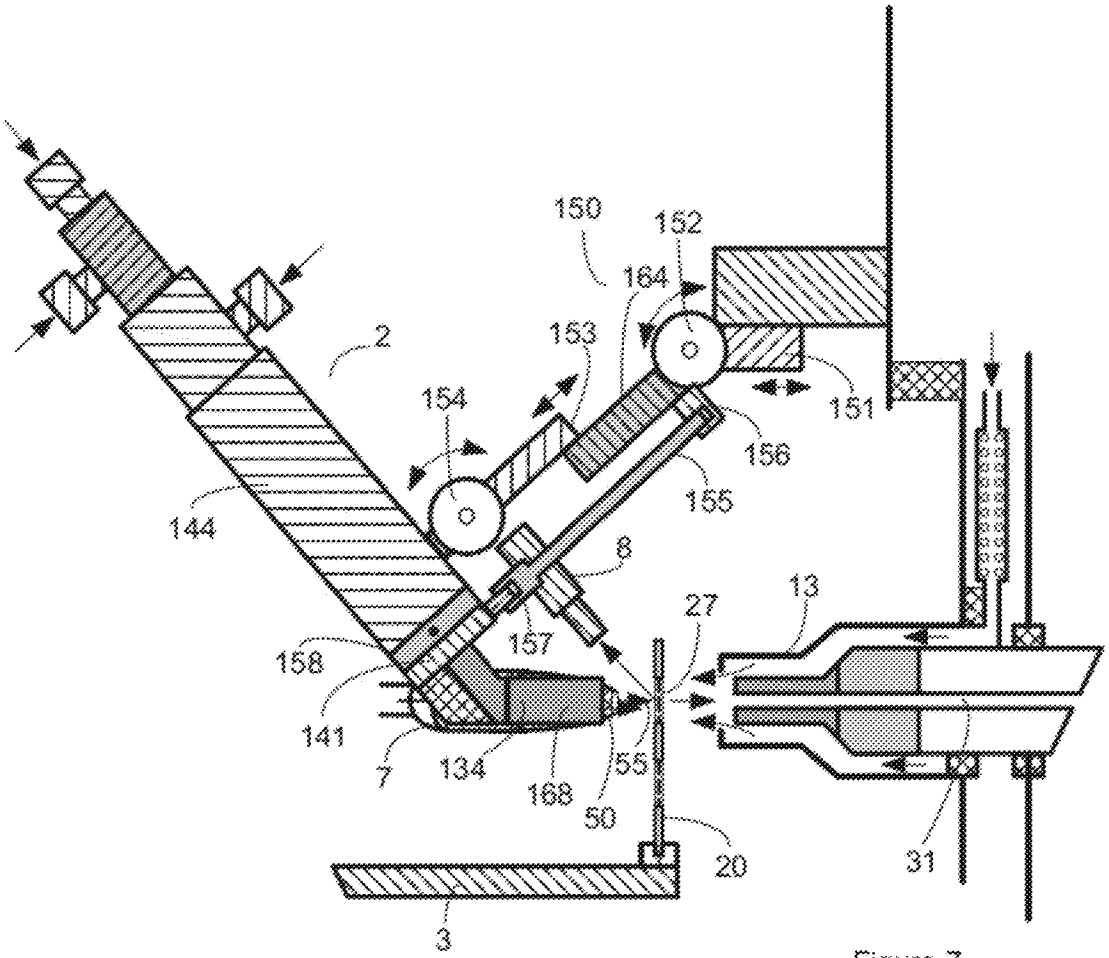
FIG. 7 is a side view of an embodiment of a DSA system that includes a multiple sample mesh target, a light heating source with a feedback pyrometer and a reagent ion generation with multiple axis translator configured with an exit in the horizontal position.

Referring to FIGS. 6 and 7, the geometry of angled reagent ion generator 2 with rotatable exit end assembly 134 enables rapid and automated positioning of exit 50 for optimal operation with different sample types. The reagent ion generator exit 50 is positioned to provide maximum ionization efficiency for each sample type with high efficiency of ion sampling into capillary orifice 30. Heater body 144 does not interfere with samples mounted to sample holder assemblies 3, 110, 132 and 162 shown in FIGS. 1, 3, 4 and 6 respectively. The linear and angled position of reagent ion generator heater body and exit 50 is adjusted with reagent ion generator four axis translator assembly 150. Some embodiments of reagent ion generator four axis translator 150 are shown in FIGS. 6 and 7 include horizontal linear axis 151, rotating axis 152, angled linear axis 153 and second rotating axis 154. Each axis can be manually adjusted or automatically adjusted with software controlled motors driving each axis. Different configurations of translation axis can be substituted for the embodiment shown in 152 while retaining similar, reduced or increased flexibility and function. Sensors can be added to measure the position of each axis in a manual or automated translator assembly which provides software with precise positioning of reagent ion generator 2 relative to a sample position and relative the fixed position of nosepiece 13. As will be described in later sections, position sensor feedback of sample holder assemblies 3, 110, 132 and 162 position and reagent ion generator 2 position to software allows for automated and optimized positioning of reagent ion generator and samples during analysis while avoiding contact with DSA ion source system 1 surfaces and electrodes.

FIG. 6 diagrams reagent ion generator 2 in a raised position with angled linear axis 153 retracted, and angled exit assembly 134 rotated to a position where exit 50 is pointing at a downward angle towards sample 160 held by sample clamp 161 mounted to movable sample holder assembly 162. As an example, sample 160 in FIG. 6 may be a piece of orange peel where the analysis is run to determine which, if any, pesticides or fungicides are present on the orange peel. FIG. 7 diagrams reagent ion generator 2 in a lowered position with angled axis 153 extended and rotatable angled end assembly 134 rotated approximately 180 degrees from the position shown in FIG. 6. The axis of removable exit piece 168 is positioned approximately in the horizontal position to optimally ionize grid sample 27 on sample holder 20. In the embodiments shown in FIGS. 6 and 7, the angle of reagent ion generator heater body 144 relative to the horizontal plane has not changed in the raised or lowered position. Linkage 155 is attached at flexible connection 156 mounted to fixed section 164 of angled linear translator 150 and is attached at flexible connection 157 mounted to rotating ring 141 of rotating angled end assembly 134. Linkage 155 causes rotating angled end assembly 134 to rotate as angled linear axis translator 153 moves from retracted position to extended position. Rotation of angled end assembly 134 is reversed as angle linear axis translator 153 moves from the extended to the retracted position. Alternatively, linkage 155 with connections 158 and 157 can be replaced by a rack and pinion gear or worm gear assembly appropriately mounted to translator assembly 150 and exit end assembly, 134. Several different designs of linkage or gear assemblies can be employed to automatically rotate exit end assembly 134 to achieve optimal positioning for each sample type. Exit end assembly 134 can also be rotated manually for optimal positioning of exit 50.

The position of reagent ion generator exit 50 can be adjusted manually or automatically during acquisition to maximize ion signal using data feedback. Four axis translator 150 can be adjusted by software based on acquired mass spectrum data and position sensor feedback. Such data dependent mechanical tuning of the sample and reagent ion generator positions can be automated using the appropriate algorithms. With such automated tuning algorithms available, different sample types, shapes and sizes can be loaded and sample and reagent ion generator positions can be adjusted automatically for optimal performance with little or no user intervention.

Reagent ion generator rotatable angle end assembly 134 includes removable end piece 140 shown in FIGS. 4 and 5 and 168 shown in FIGS. 6 and 7. The exit inner diameter of removable end piece 140 is reduced compared to the exit inner diameter of end piece 168. Smaller inner diameter end piece 140 delivers heated gas and reagent ions in a smaller diameter flow which may be desirable for some sample types. For other sample types where a larger heated gas and reagent ion flow diameter is more optimal, larger diameter end piece 168 would be selected. Shorter or longer and different diameter end pieces can be interchanged on reagent ion generator 2 rotatable angled end assembly 134.

One or more heating light sources 7 can be mounted to rotatable angled end assembly 134 that includes rotating ring 141 so that heating light 125 automatically remains oriented in the direction of heated reagent gas and reagent ion flow 55 when end assembly 134 is rotated. Similarly, pyrometer 8 can be mounted to rotatable angled end assembly 134 positioned to point at the sample location impinged by heating light source 7 and heated gas and reagent ions 55. Alternatively, one or more heating light sources 7 and one or more pyrometers 8 can be positioned independently of reagent ion generator 2 position and translationally referenced instead to the sample position and fixed position nose piece 13 with appropriate translationally adjustable mounting bracket assemblies.

Figure 8:
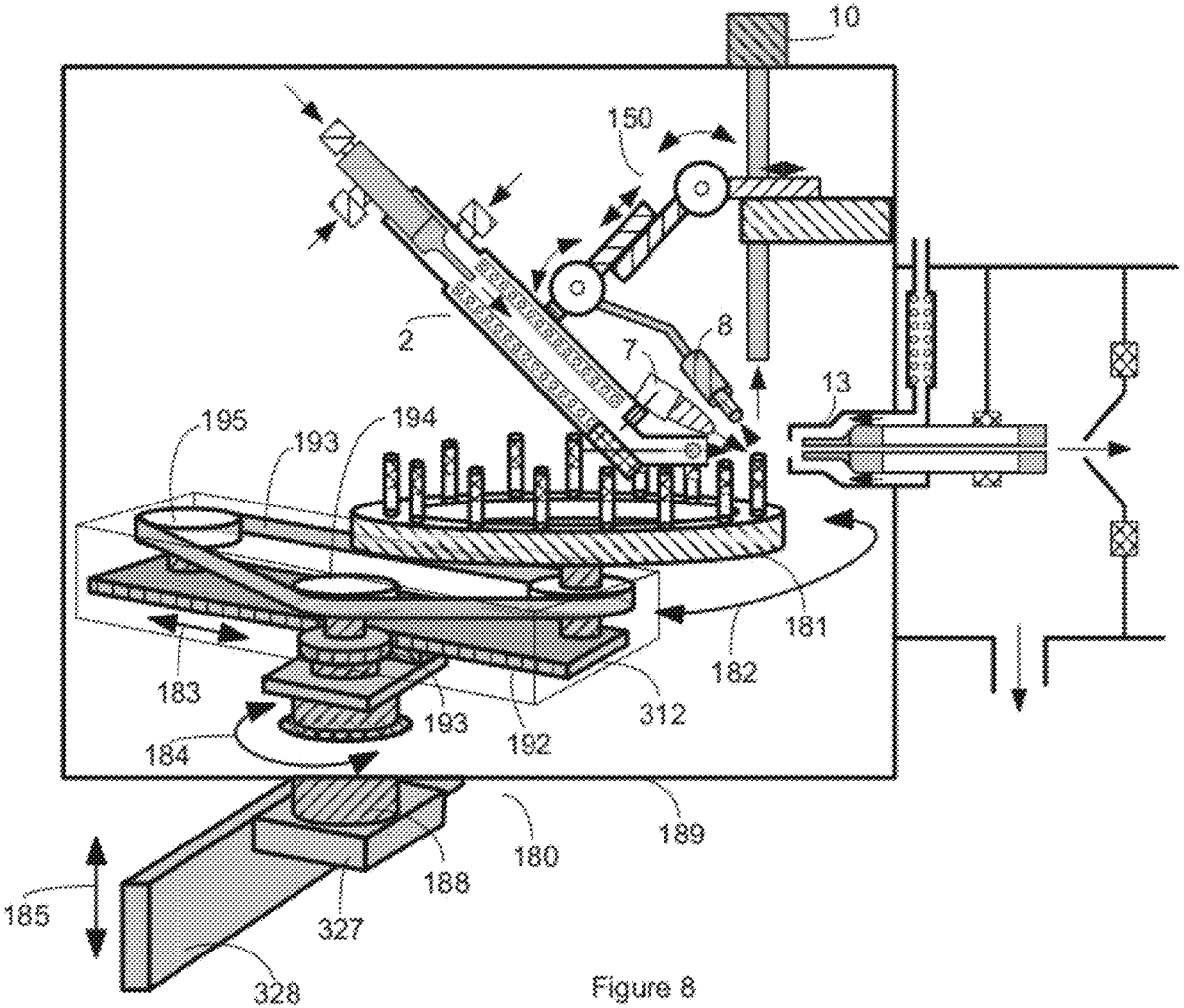
FIG. 8 is a partial cut away view of an embodiment of a DSA system that includes a four axis sample holder translation stage, a multiple axis reagent ion generator translator, a sample position sensor, a light heater source with a feedback pyrometer and a sample tube holder.

In some embodiments, sample holder assemblies 3, 100, 132 and 162 shown in FIGS. 1, 3, 4 and 6, respectively, are mounted on four axis translator assembly 180, shown in FIG. 8, for automated positioning and movement of samples. Some embodiments of such sample holder assembly on four axis translator assembly 180 are diagrammed in FIGS. 8, 9 and 10. Four axis translator assembly 180 provides a full range of motion for analyzing different sample types with one or more samples mounted to three dimension sample holder assemblies 3, 110, 132, 162, 181 and other configurations and embodiments of sample holder assemblies. Four axis translator assembly 180 includes sample holder assembly 181 rotation axis 182, horizontal linear translation axis 183, rotation axis 184 and vertical linear translation axis 185. Multiple shaft rotating shaft assembly 188 extends from below base plate 189, through sealed opening 191 base plate 189 and into enclosure 187 similar to enclosure 14 diagrammed in FIG. 1. The four axis translator 180 components configured inside enclosure 187 include metal or other inert materials to prevent background contamination gas molecules from interfering with sample analysis.

Figure 9:
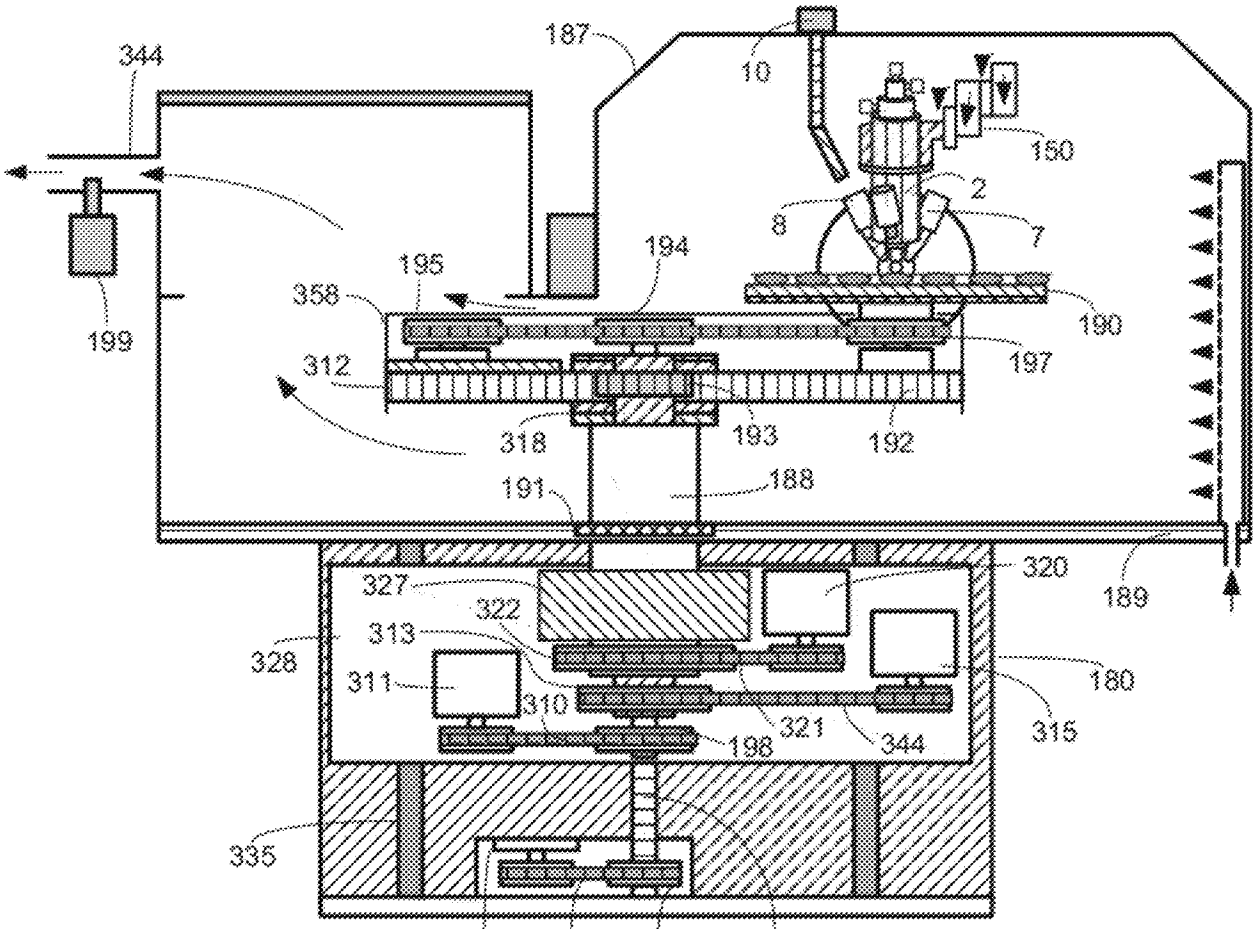
FIG. 9 is a front view of an embodiment of a DSA ion source system that includes a four axis multiple sample holder translator loaded with a multiple sample holder positioned for analysis of solid pill samples.
Figure 10:
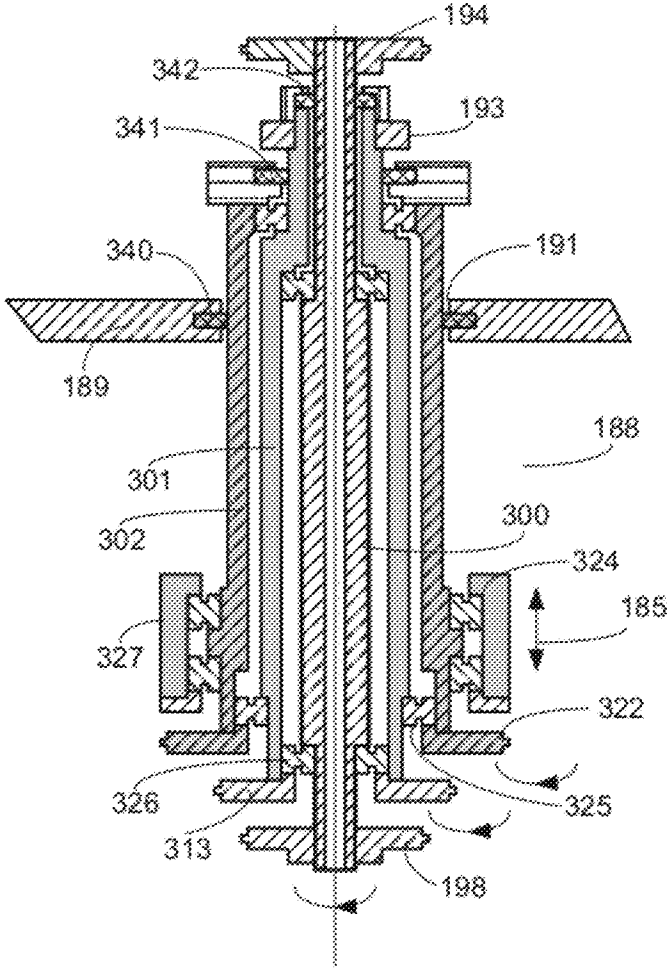
FIG. 10 is a cross section view of an embodiment of a four axis sample holder translator that includes layered rotating and translating shafts having seals.

In the embodiments shown in FIGS. 8, 9 and 10, horizontal linear translation axis 183 includes gear rack 192 and rotating pinion gear 193 to effect horizontal linear translation of sample holder assembly 181 or 190. Rotating pinion gear 193 is mounted on the top end of middle shaft 301 in shaft assembly 188. Middle shaft rotation is driven by motor and sprocket assembly 315 connected through chain or cogged belt 344 to middle shaft lower sprocket 313. Horizontal linear translator assembly 312 slides through linear bearing guides 318 enabling low friction precision linear motion. Sprockets 195 and 197 are rotatably mounted to horizontal translation rack assembly 312. Rotation of sample holder assembly 181 or 190 throughout its full horizontal linear motion range is effected by rotating inner shaft 300 connected to chain or cogged belt 193 through sprocket 194. Chain 193 wraps around spring loaded idler sprocket 195, driven sample holder sprocket 197 and driver sprocket 194. Inner shaft lower sprocket 198 is driven through chain or linked belt 310 by motor and sprocket assembly 311. Rotation axis 184 rotation is effected by rotation of outer shaft 302 driven by motor and sprocket assembly 320 connected through drive chain or cogged belt 321 to outer shaft lower sprocket 322. Through bearings 324, outer shaft 302 is mounted in bearing block 327 which is in turn mounted to linear vertical axis 185 translation plate 328. Vertical translation plate 328 motion is effected by turning lead screw 330, driven by motor and sprocket assembly 332 connected to lead screw lower sprocket 331 through chain or cogged belt 334. Vertical translation plate 328 slides on rails 335 to effect low friction precision motion. Rotation of inner shaft 300 and middle shaft 301 ride on bearings 326 and 325, respectively, allowing low friction rotating precision motion.

Four axis sample holder translator assembly 180 includes two rotation seals and one slider rotation seal that provide tight gas sealing through enclosure 187 base 189 during all four axis motion while creating no detectable chemical contamination inside enclosure 187. Circular shaft seal 340 provides a rotating and sliding seal to outer shaft 302. Shaft seal 341 provides a rotating seal against middle shaft 301 and shaft seal 342 provides a rotating seal against inner shaft 300. Seal material includes teflon or other material that provides an effective gas tight seal while having no contribution to 20 background gas phase contamination inside enclosure 187. No leaky or potentially sticky linear seals are used. Evaporated sample molecules are effectively trapped in sealed enclosure 187 and swept out vent port 344 into a safe laboratory vent system, preventing any exposure to the user. Conversely, ambient contamination is prevented from entering enclosure 187 during analysis, thereby providing operating and analytical benefits as described above.

Four axis translator assembly 180 provides the complete range of motion required for sample shape and surface profiling, sample position checking, optimized analysis, loading and unloading of sample holder assemblies, and for effecting full sample holder plate profiling to determine sample holder type, sample type, numbers, positions and heights prior to analysis. FIGS. 11 through 20 illustrate an automated progression of sample analysis, unloading of an analyzed sample set, loading of a new sample set, sensor profiling of the new sample set and analysis of the new sample set.

Figure 11:
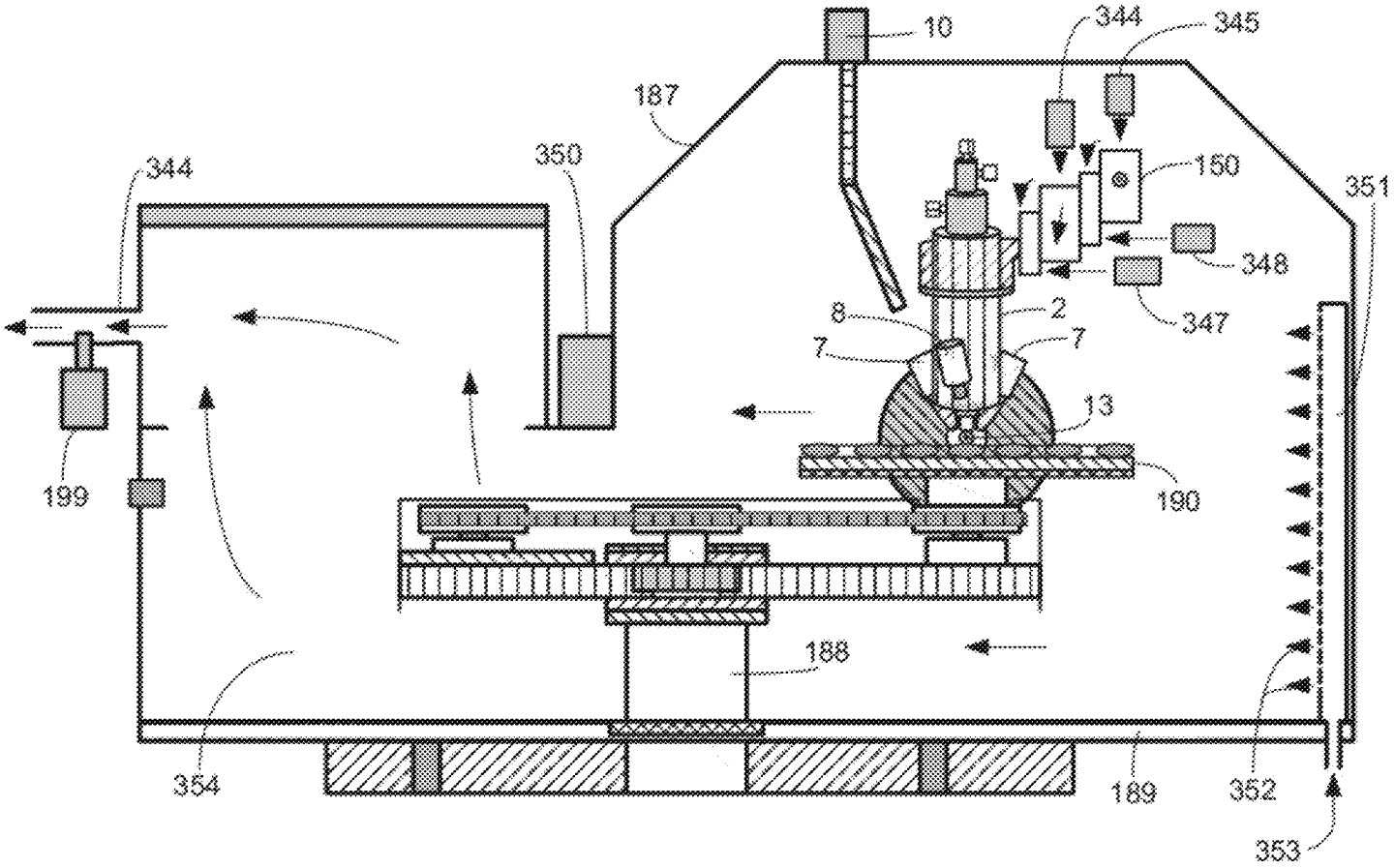
FIG. 11 is a front view of a multiple sample holder for pills positioned for sample analysis in a DSA ion source enclosure with purge gas flowing.

Referring to FIG. 11, round sample holder assembly is loaded with a set of pill samples that are analyzed sequentially by rotating sample holder assembly with pills passing in front of nose piece 13. Reagent ion generator 2 is located with exit 50 in a downward angled position similar to that shown in FIG. 6. Controlled heating of samples are effected by heated reagent gas and ions 55 and heated light sources 7 with pyrometer 8 sample temperature feedback as described above. Position sensors 334, 345, 347 and 348 senses the position of each axis of the reagent ion generator 2 four axis translator assembly, respectively, and feeds back the precise position of reagent ion generator 2 to software. Purge gas 353, typically nitrogen, flows through base plate 185 and into gas manifold 351. Purge gas 352 flowing from gas manifold 351 moves through ion source volume 354 inside enclosure 187 sweeping evaporated sample molecules out through vent 344 past moisture or humidity sensor 199 and into a safe laboratory vent system. Purge gas 352 sweeping of evaporated sample molecules out vent 344 minimizes sample contamination cross talk between samples.

In conjunction with continuously flowing purge gas 352, minimizing contamination cross talk between samples can be achieved by moving sample holder 3, 110, 132, 162, 190 or 371 to a position where the regent ion generator exiting gas flow 55 or any light heat sources do not impinge on a sample position or sample holder surface. For example, lowering the position of sample holder assembly 190 in FIG. 11 after running a sample prevents preheating of the next sample to be analyzed while contamination from the previously run sample has time to be swept away by purge gas flow 352. Also, increasing the intensity of light heater 7 briefly and increasing the flow of heated reagent gas 55 will drive condensed sample species off nose piece 13 surfaces and capillary electrode 12 surfaces prior to analyzing the next sample. When the reagent ion generator 2 is positioned with exit 50 oriented in a down position, the position of reagent ion generator 2 can be rapidly moved to provide a horizontal exit 50 position between sample analysis. With reagent ion generator exit 50 oriented in a horizontal position, heated reagent gas flow 55 and/or light heater 7 are directed toward the face of nose piece 13 and capillary entrance electrode 12. Any contamination which may have accumulated on nosepiece 13 or capillary entrance electrode 12 will be re evaporated by this direct heating and the previous sample contamination molecules are swept away by counter current drying gas flow 70 and purge gas flow 352 and exit through vent 344 prior to running the next sample. The intensity of light heater 7 and the flow rate of heated reagent gas flow 55 can be increased to accelerate contamination molecule evaporation rate, effectively decreasing the electrode cleaning time period. Mass spectra can be acquired during this cleaning and purge step to monitor the level of background or contamination sample remaining. This purge step can be continued until background chemical noise in acquired spectra has been reduced to an acceptable level using data dependent feedback algorithms or alternatively can be continued for a programmed time duration with no data dependent feedback. When an acceptable reduction in background or contamination signal has been achieved, light heater 7 intensity is turned down and the heated reagent gas and ion flow 55 is reduced to the optimal level for analysis. Sample holder assembly 190 is then moved to the optimal position for analysis rotated to present the next sample pill for analysis. The sample analysis and contamination reduction step between sample analysis can be programmed for automated operation through software or conducted through manual control. Sample holders can be configured to provide regions where gaps in sample or sample holder surfaces appear. The sample holder translator 180 can move to gaps in a sample holder between analysis to conduct a purge or cleaning step. In this manner a sample holder position requires minimum movement between sample analysis.

Figure 12:
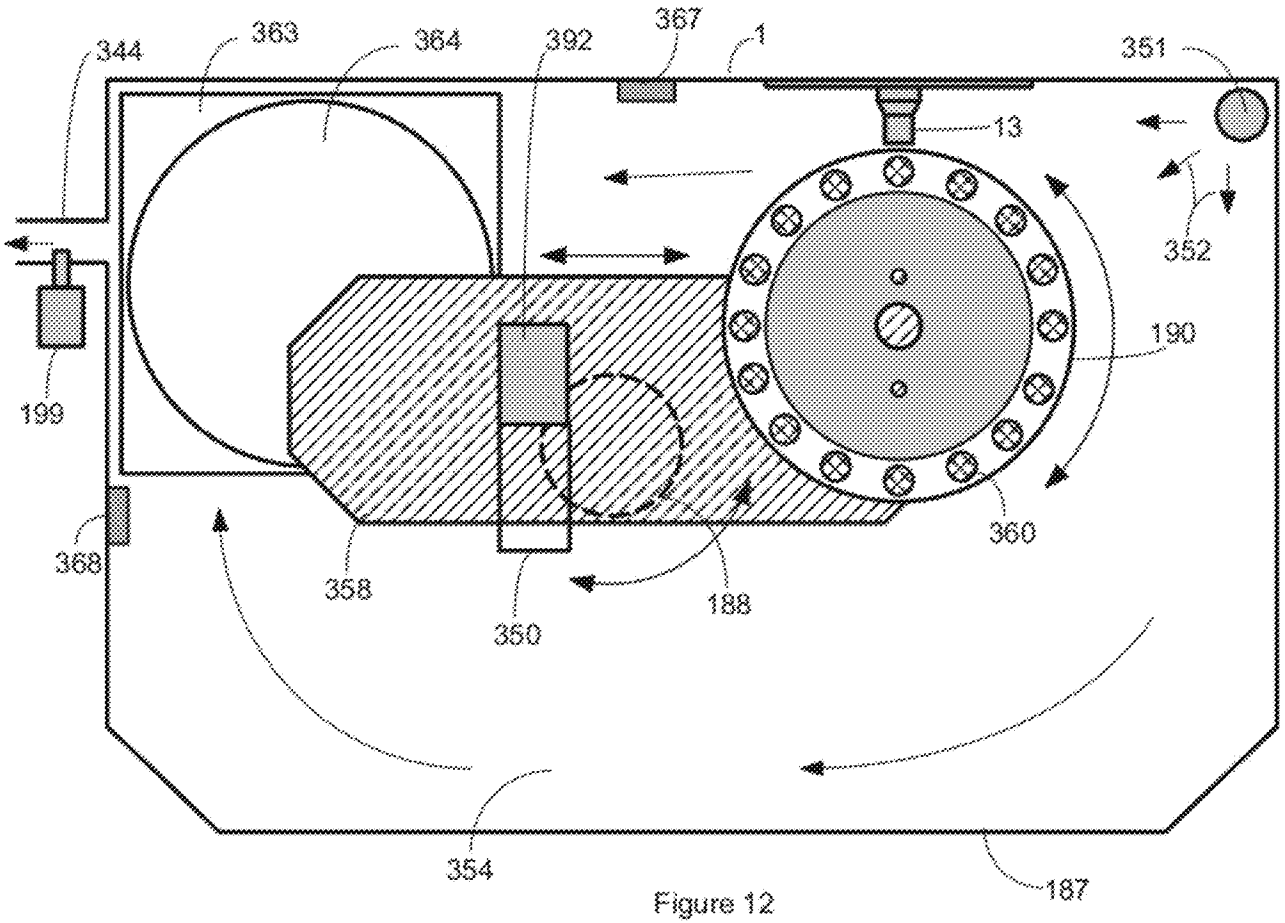
FIG. 12 is a top view of a sample holder positioned for sample analysis in a DSA ion source enclosure with purge gas flowing.
Figure 13:
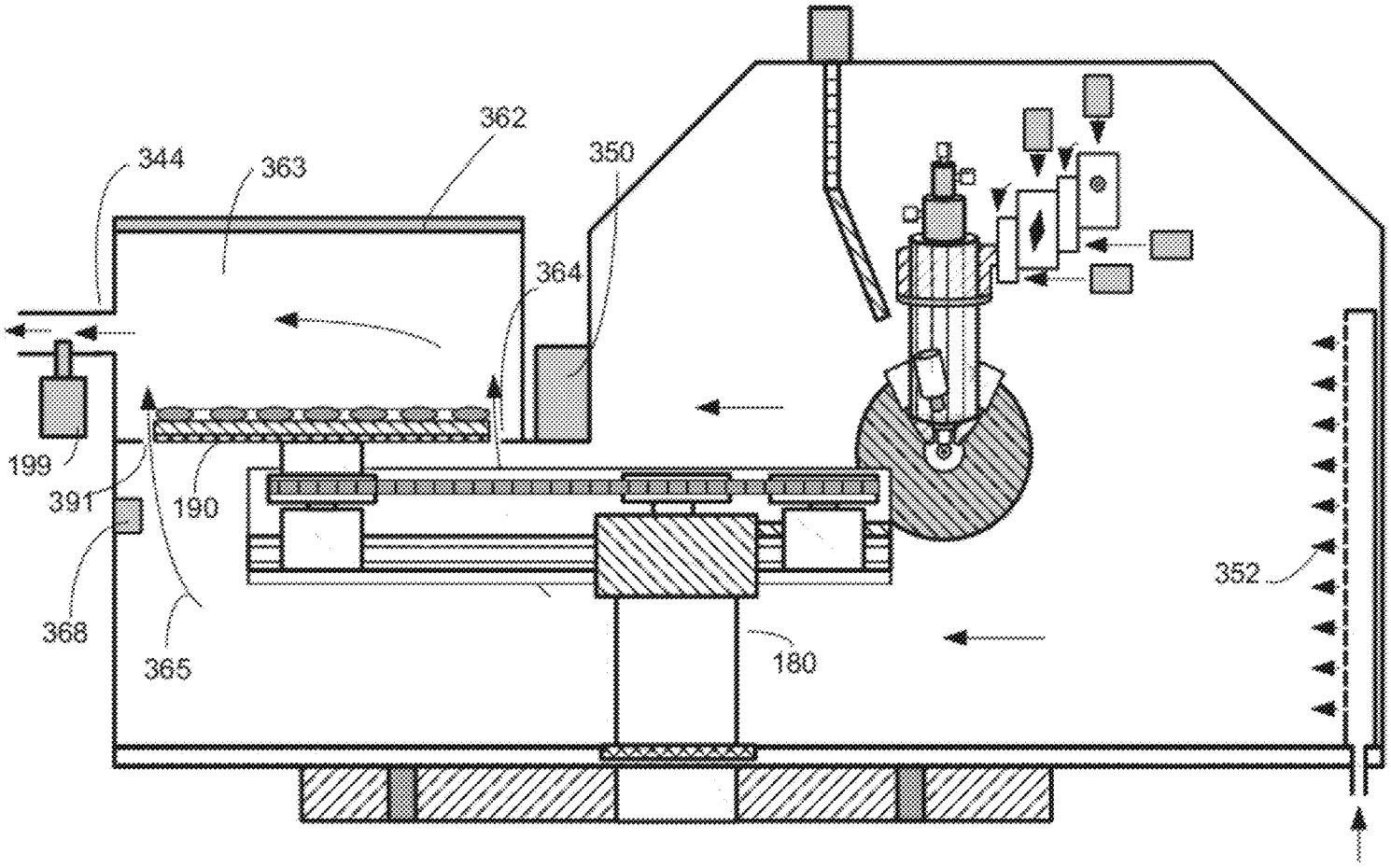
FIG. 13 is a front view of a multiple sample holder positioned for removal from an embodiment of a DSA ion source enclosure subsequent to conducting analysis on the loaded solid pill samples with purge gas flowing.

FIG. 12 shows a top view of DSA ion source 1 enclosure 187 during sample analysis that includes sample holder assembly 190 with pill samples 360 mounted in a circular pattern. Shield 358 covers four axis translation assembly 180 and multiple shaft assembly 188. Purge gas 352 flowing from manifold 351 is directed to sweep the full volume 354 inside enclosure 187.

Figure 14:
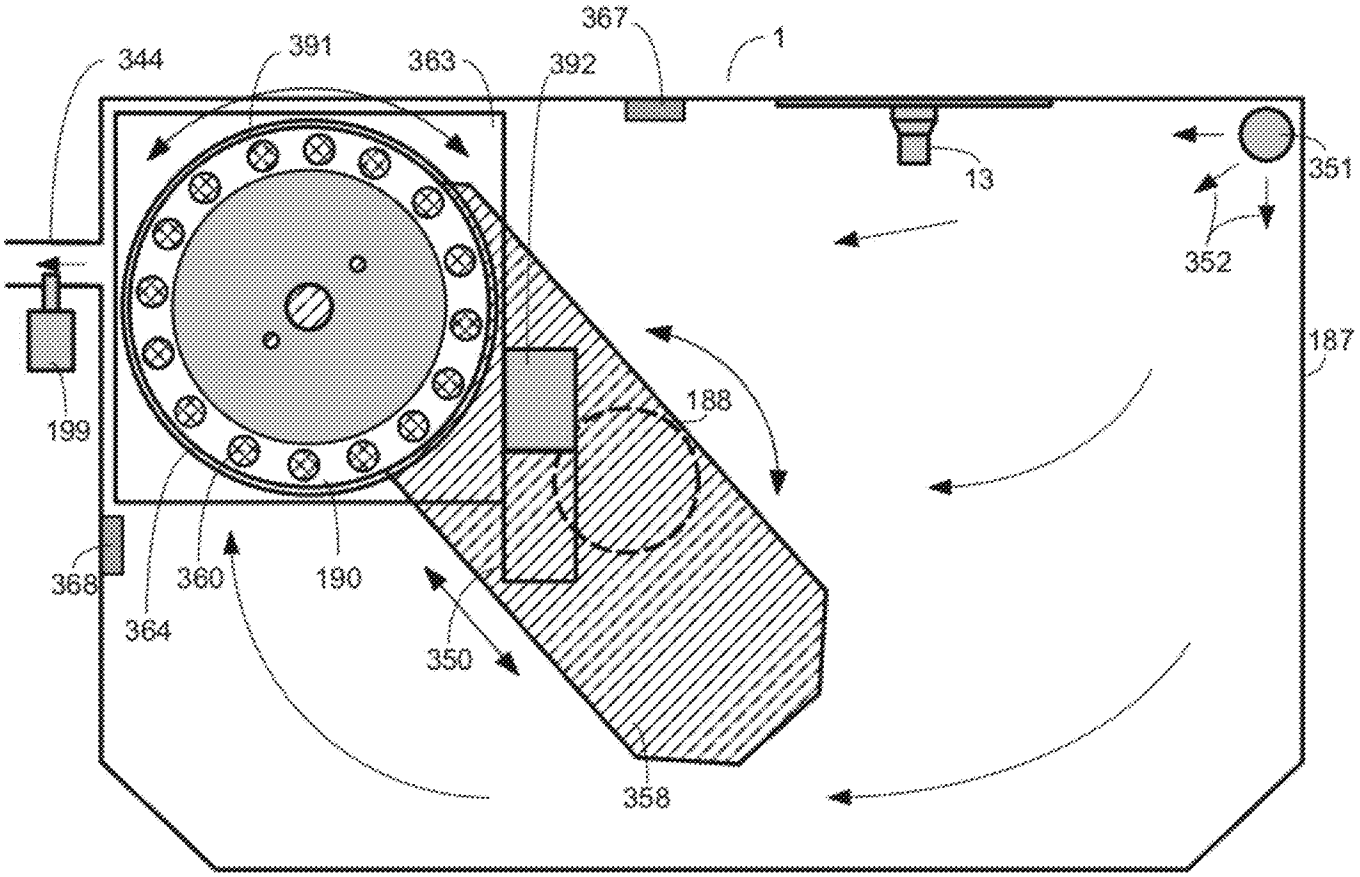
FIG. 14 is a top view of a multiple sample holder positioned for removal from an embodiment of a DSA ion source system enclosure with purge gas flowing.

When some or all pills 360 mounted on sample holder assembly 190 have been analyzed, sample holder assembly 190 is moved to the unload position in opening 364 of sample loading and unloading region 363. Purge gas flow 365 continues to sweep by sample holder assembly 190 through gap 391 between sample holder 192 and opening 364 and out vent port 344. When moving sample holder assembly 190 to its load and unload position, four axis translator assembly 180 passes through or by position sensors 367, 350 and 368 to reset the reference location of horizontal linear axis translator assembly 312 and sample holder assembly 190 rotation axis 182 respectively. Four axis translator vertical linear axis 185 and rotation axis 184 zero positions are also revalidated by position sensors located below base plate 185 outside enclosure 187. Referencing FIG. 13, when sample holder assembly 190 is located in opening 364, its position is known precisely and validated by software. FIG. 14 shows a top view of sample holder assembly 190 positioned in opening 364 just prior to unloading.

Figure 15:
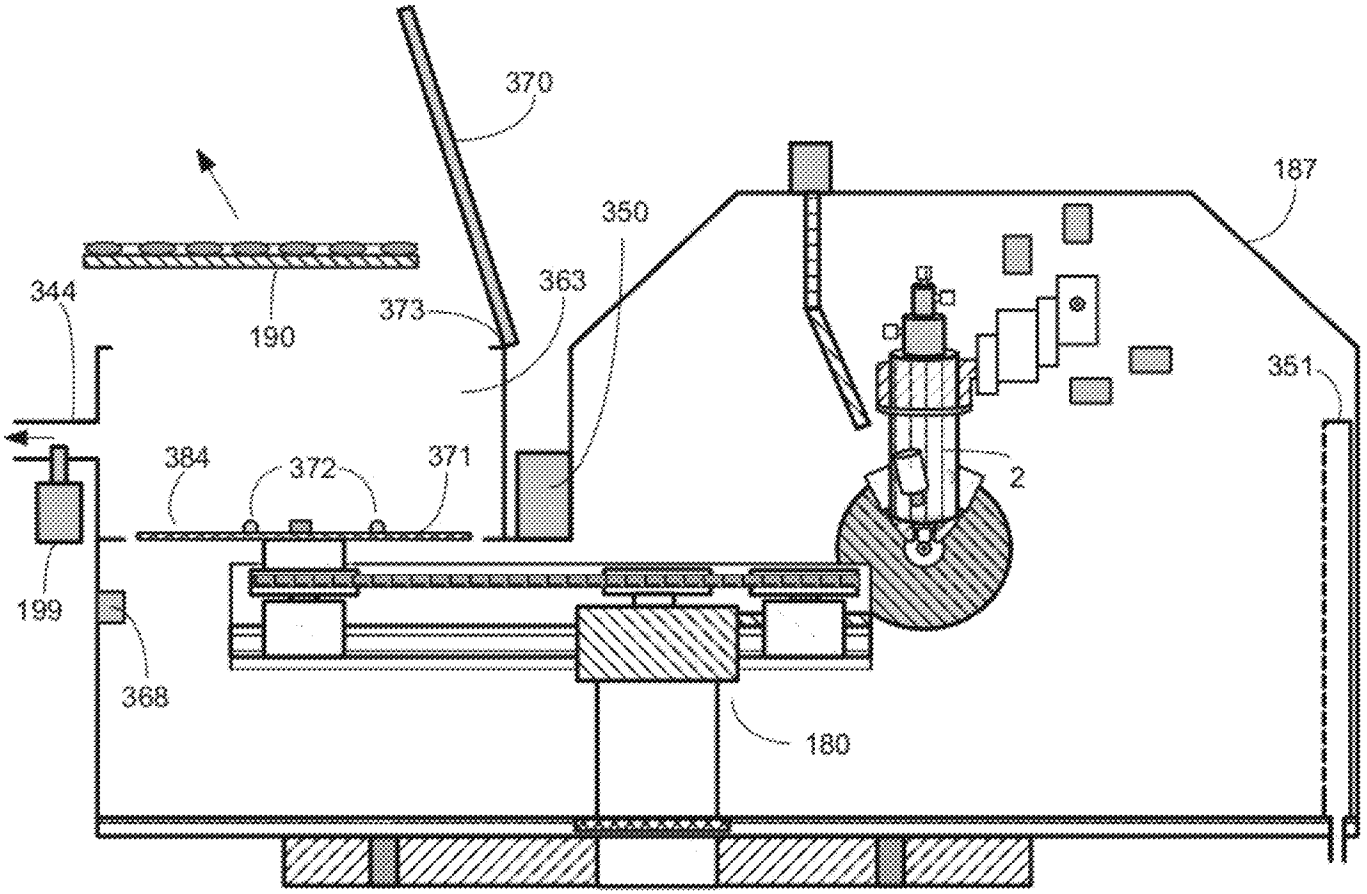
FIG. 15 is a front view of a multiple sample holder being removed from an embodiment of a DSA ion source system enclosure with purge gas flow turned off.
Figure 16:
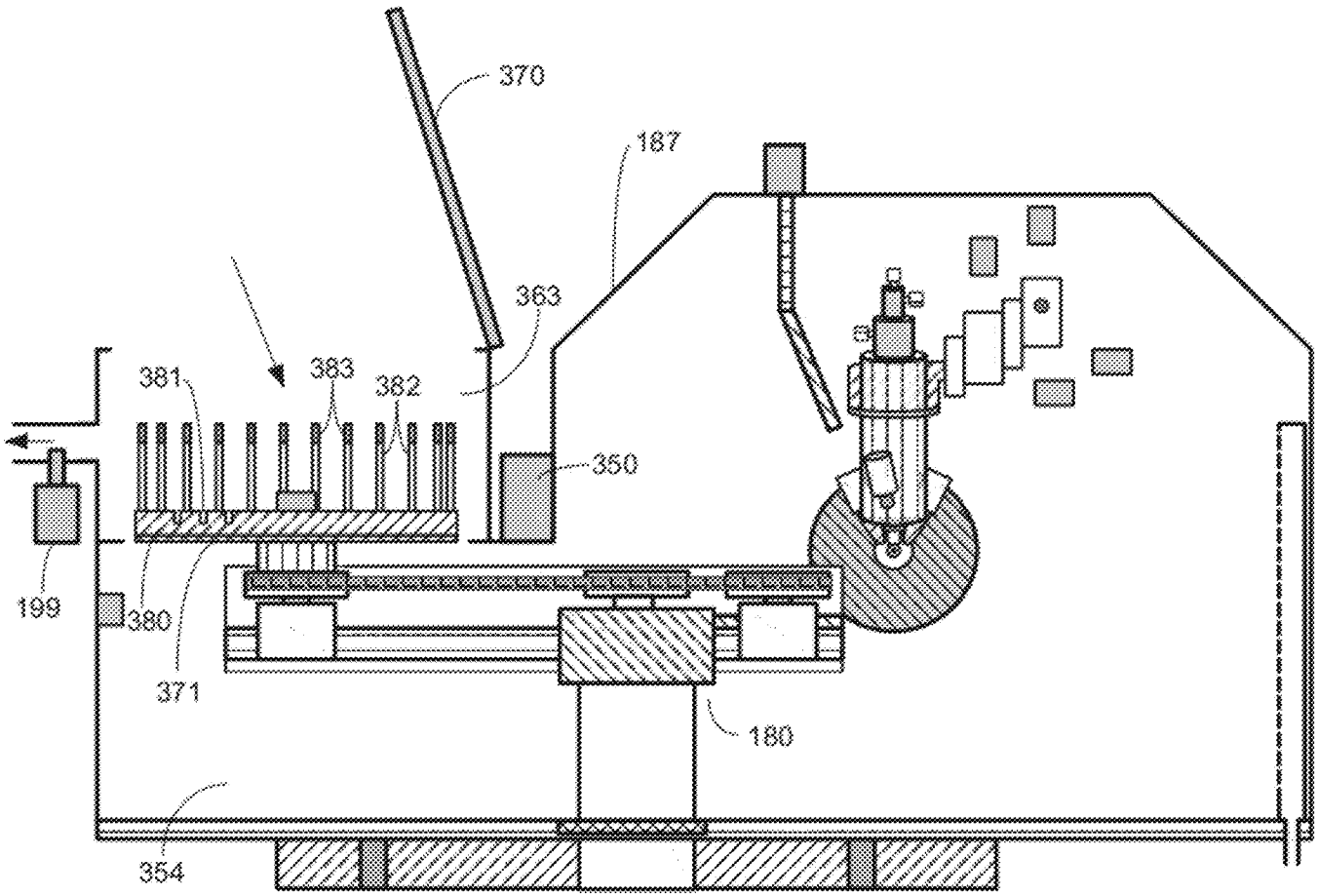
FIG. 16 is a front view of a multiple sample holder being loaded into an embodiment of a DSA ion source system.

Referring to FIG. 15, sample holder assembly 190 is removed from DSA ion source 1 enclosure 187. Top lid 370 is opened along hinge 373 to facilitate either automated or manual removal of sample holder assembly 190. Remaining sample reference plate 371, attached to four axis translator 180, includes position reference mounting pins 372. Purge gas 352 flowing from manifold 351 may be turned off to avoid exposing the user to any residual evaporated sample species still present within enclosure 187. Alternatively, if source purging time is sufficient to clean the source of any residual gas phase sample molecules prior to opening top lid 370, then purge gas flow 365 can remain turned on to minimize or prevent ambient contamination from entering DSA source volume 354 during loading or unloading of samples. Referring to FIG. 16, new sample holder assembly 380 is loaded onto sample reference plate 371 in loading region 363. Sample holder assembly 380 includes sample tubes 382 with loaded powder samples 383 and plate identifier hole pattern 381. Referencing alignment pins 372 and the top surface 384 of sample reference plate 371 establish the precise position of sample holder assembly 380 which is known by software. Software has not yet validated how many samples have been loaded and what are the specific positions and heights of each sample. Purge gas flow 352 remains on or off depending on the user or method preference.

Figure 17:
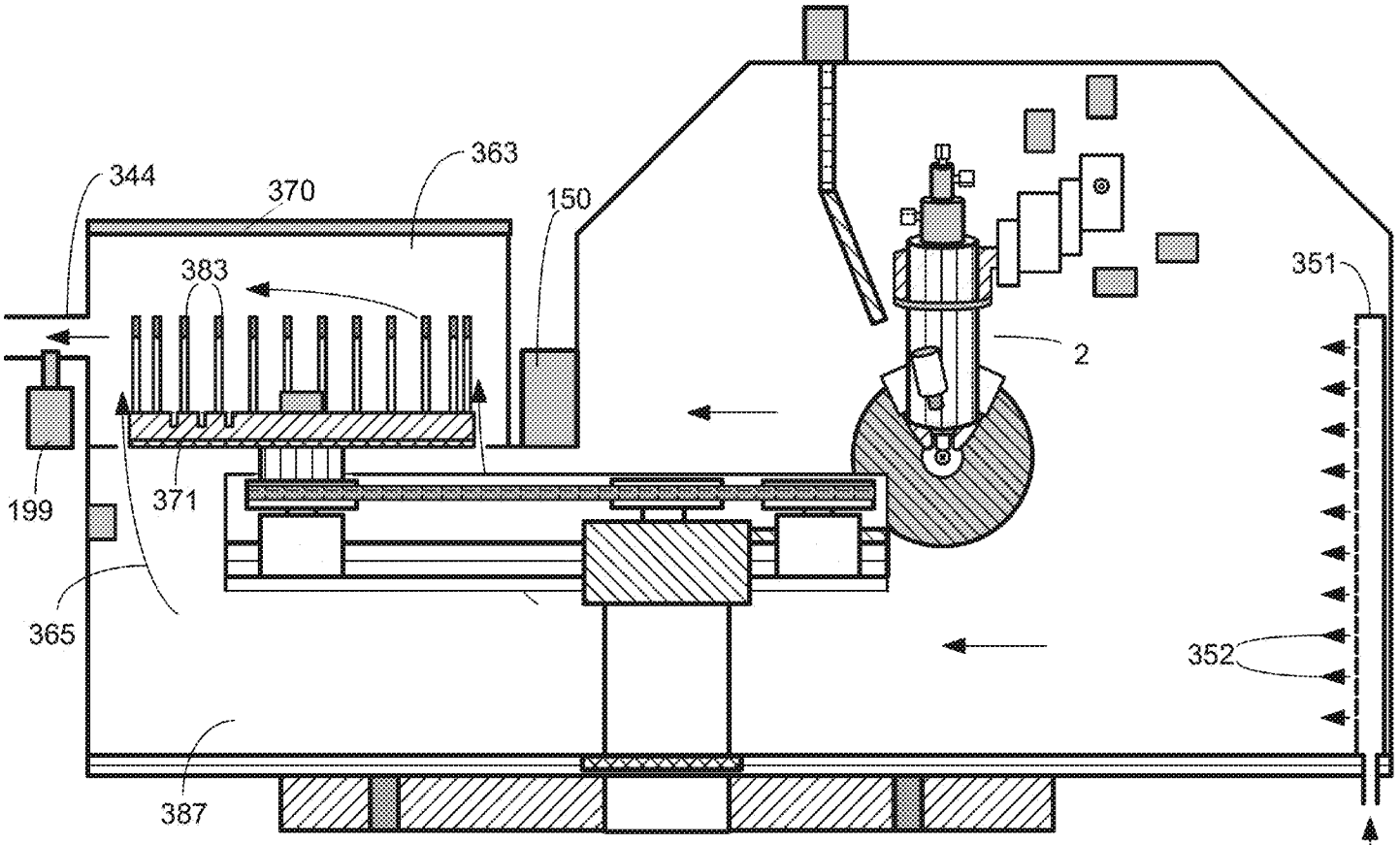
FIG. 17 is a front view of an embodiment of a DSA ion source system in which the ion source enclosed volume and the sample loading region volume are purged after a new sample holder is loaded prior to conducting sample analysis.

Referring to FIG. 17, top lid 370 is closed and seals when closed. Purge gas flow 352 from gas manifold 351 forming purge gas flow 365 is turned on if it was previously turned off or remains on if the previous state was on during the loading of sample holder 380. Purge gas flow 365 enters loading region 363 and exits through vent 344 passing by moisture or humidity sensor 199 to lowering sample holder assembly with samples 383. Humidity sensor 199 configured in vent line 344 or alternatively positioned in sample loading region 363, measures the moisture content of the exiting purge gas 365. Newly loaded sample holder 380 and samples 383 are dried by purge gas 365 with feedback of moisture contact provided to software by moisture sensor 199. When the introduced moisture level has been reduced to a desired level, sample holder assembly 380 can be moved into DSA source volume 354. Alternatively, it may be preferred the run liquid or wet samples in which case pre-drying of the sample with purge gas 365 would be minimized after sample loading. Purging region 363 and further drying samples, if desired, with moisture sensor feedback from humidity sensor 199 provides a controlled means to consistently pre condition samples prior to analysis. Controlled sample preparation and conditioning prior to analysis enables improved consistency and reproducibility in sample evaluation.

During this purging of region 363 after sample loading region, reagent ion generator 2 remains turned on with mass spectra being acquired to check the level of background chemical contamination in DSA source volume 354. The sample loading purge cycle as described above can continue until the ambient background signal is sufficiently reduced as determined by data dependent feedback through evaluation of mass spectra acquired during the post sample loading purge cycle. Calibration solution can be introduced into reagent ion generator 2 as described above to tune and calibrate mass analyzer 78 before samples 383 are run. With continued purging, when the background chemical noise level observed in acquired mass spectra has reduced to an acceptable level and/or, if desired, the moisture level in venting purge gas 365 is sufficiently low, sample holder assembly 371 with samples 383 loaded is lowered into DSA ion source region 387.

Figure 18:
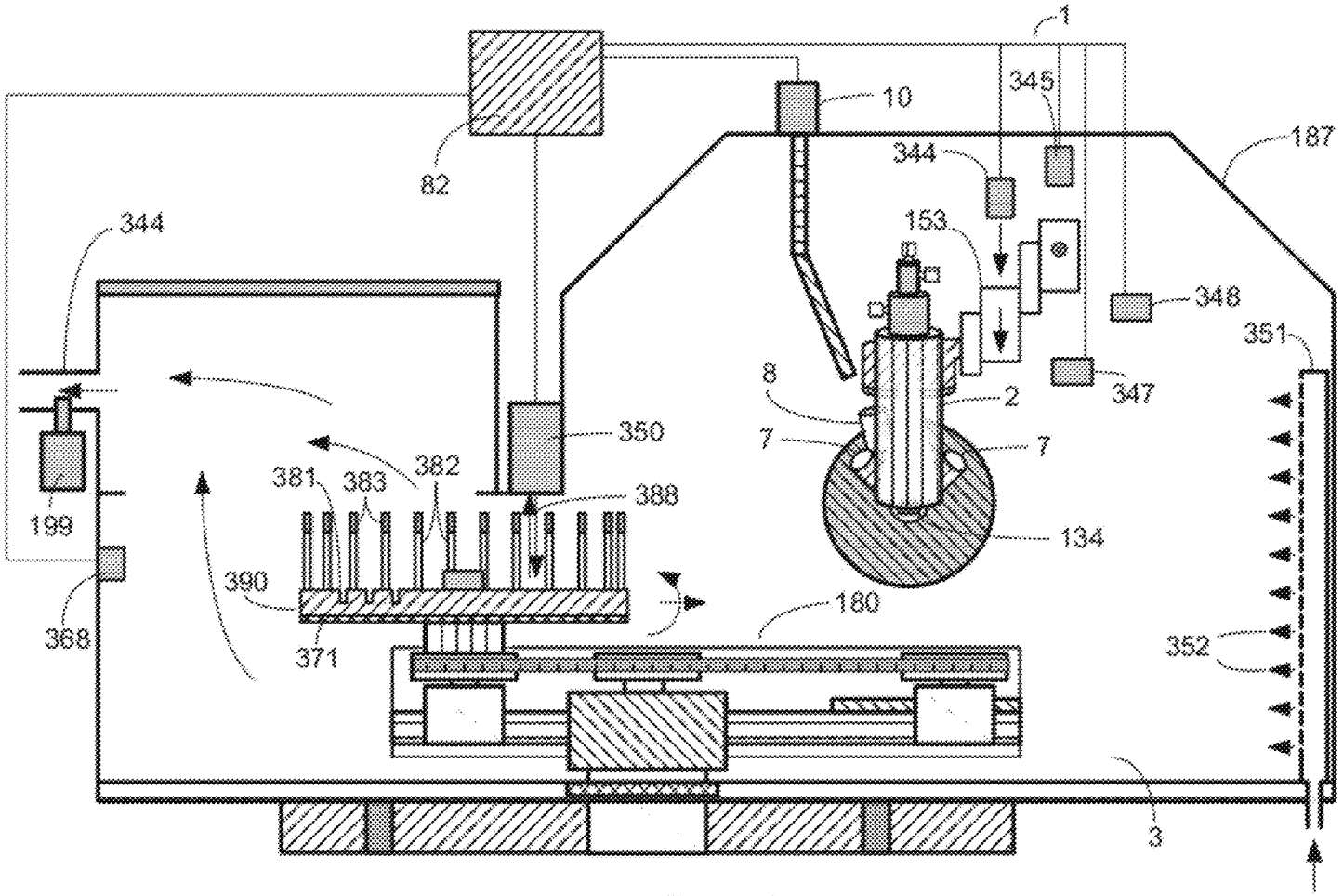
FIG. 18 is a front view of an embodiment of a DSA ion source system during the steps of target sample identification and sample contour mapping using at least one distance sensor.
Figure 19:
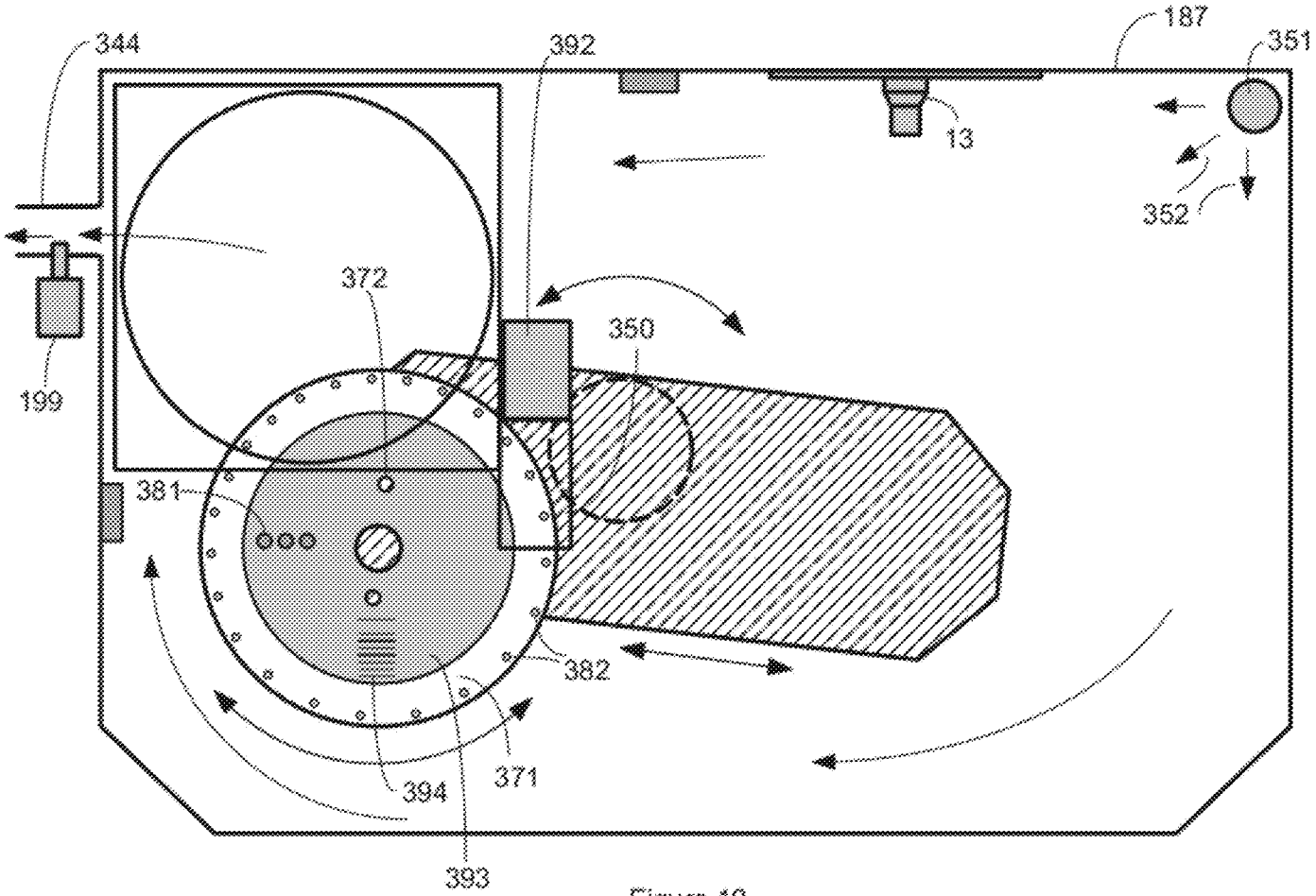
FIG. 19 is a top view of an embodiment of a DSA ion source during the steps of sample target identification and sample contour mapping using at least one distance sensor and sample holder translation.

Referring to FIGS. 18 and 19, sample holder assembly 371 is moved under distance measuring sensor 350. One embodiment of distance measuring sensor uses a laser beam and light sensor to measure the height of objects moved under the sensor. The position of sample holder assembly 371 is translated and rotated under distance measuring sensor 350, and sample plate identifier hole pattern 381 is mapped to identify the sample holder assembly 390 type. Alternatively top surface 393 of sample holder 380 may include a bar code 394 to identify sample plate holder type 380. Optical bar code reader 392 shown in FIGS. 12 and 19 is used to read bar code 394 as sample holder 380 is translationally moved under bar code reader 392.

Using distance sensor 150 and sample holder translator 180 the number, location and height of each sample tube 382 are mapped and matched to the sample list loaded into software. Using the sample holder plate identification and sample position mapping information generated by distance measuring sensor 350 and bar code reader 392, sent to software and electronics controller 82, software adjusts the position of reagent ion generator 2 and rotatable angle exit assembly 134. Motorized angled linear axis translator 153 position is moved to its extended position in reagent ion generator four axis translator assembly as described for FIG. 7. With position measuring sensor 344 feedback information sent to software, the software automatically verifies the new reagent ion generator probe position. Based on the input from multiple sensors, DSA ion source 1 components automatically adjust to provide optimal analysis of newly loaded sample tubes 382. Purge gas flow 352 remains on to reduce background contamination and to establish a known back ground gas composition within enclosure 187 prior to initiating sample analysis. FIG. 19 shows a top view of DSA system 1 that includes position measuring sensor 350 which is used to identify sample holder assembly 390 type and to maps sample positions of newly loaded sample holder assembly 390. Alternatively, in addition, DSA system 1 includes bar code reader 392 to identify sample holder assembly 390 type.

Distance sensor 150 can be used to map the contour of sample surfaces enabling software algorithms to set the optimal position of the sample for analysis. Four axis translator 180 moves a sample under the laser beam of distance sensor 150 to produce a map of the surface elevations and the edges of the sample. For example, if an orange peel is loaded into DSA ion source system 1, as shown in FIG. 6 held by clip 161, the surface and edges are mapped using Distance Sensor 150. The sample is then optimally positioned with respect to orifice 30 into vacuum to maximize sensitivity and avoid sample contact with nose piece 13 or reagent ion generator removable end piece 51. In addition, the position of reagent ion generator 2 can be set in relation to the sample to provide optimal sample ionization conditions. Each sample can be profiled using distance sensor 150 or additional sensors from which its position can be optimized for analysis automatically on a sample by sample basis.

Figure 20:
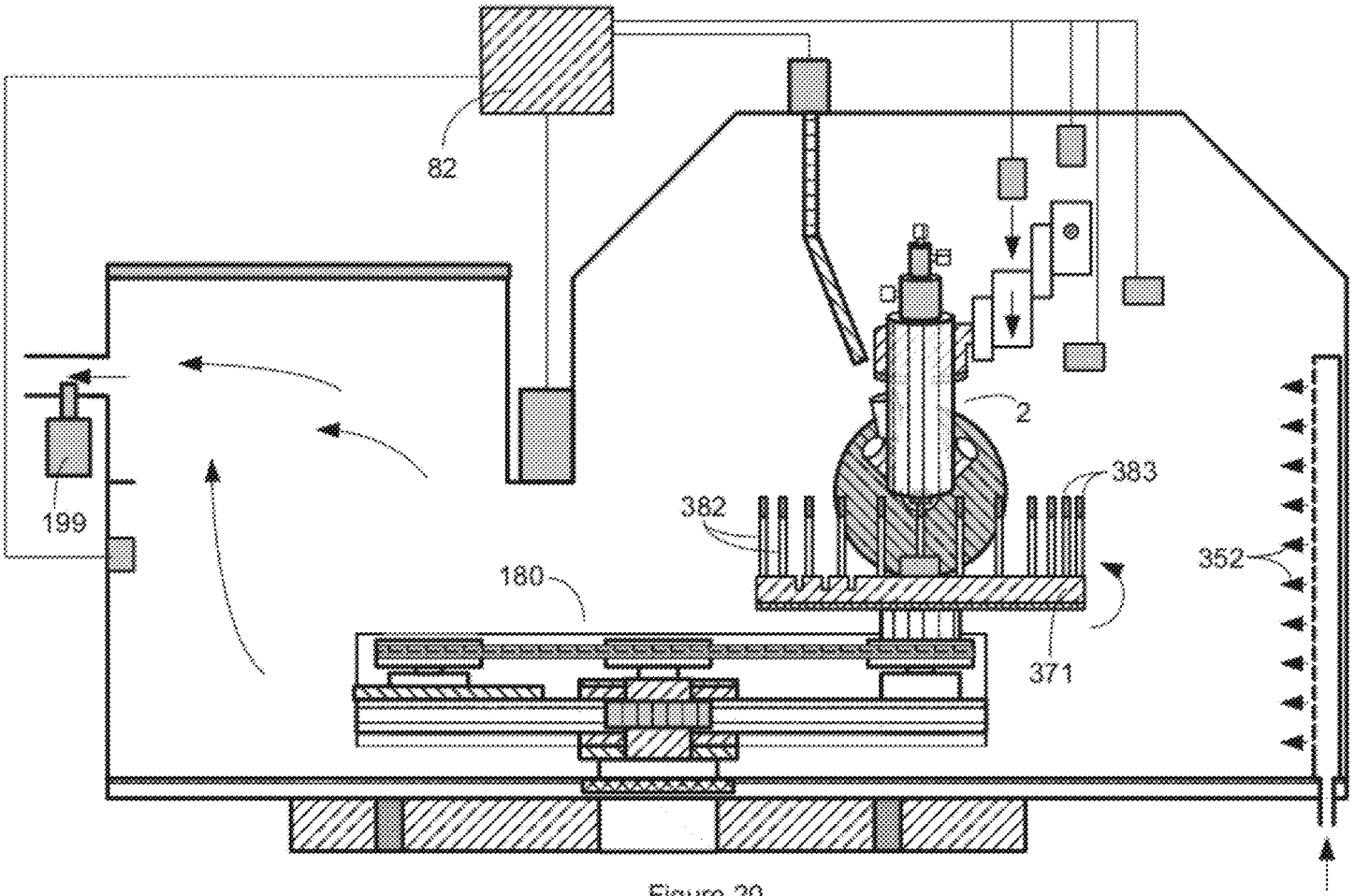
FIG. 20 is a front view of an embodiment of a DSA ion source configured with the sample holder positioned to conduct analysis and a reagent ion generator moved to a lower position with its exit end automatically rotated 180° to provide optimum reagent ion delivery to a sample loaded in a vertically positioned tube.

Referring to FIG. 20, after the newly loaded sample holder assembly 390 has been identified and some or all loaded sample 383 positions mapped, sample holder assembly is moved to the optimal position to conduct sample analysis of loaded samples 383 by four axis translator 180. In addition, reagent ion generator 2 has been optimally positioned automatically through software control to conduct sample analysis. Purge gas 352 remains on during analysis of samples 382 to minimize sample contamination carryover employing purge cycles in between sample analysis as described above. For example, sample holder assembly 390 can be lowered or moved to a position in between samples after analyzing a sample to reduce previous sample contamination carry over as described above for previous sample holder assembly 190.

Figure 21:
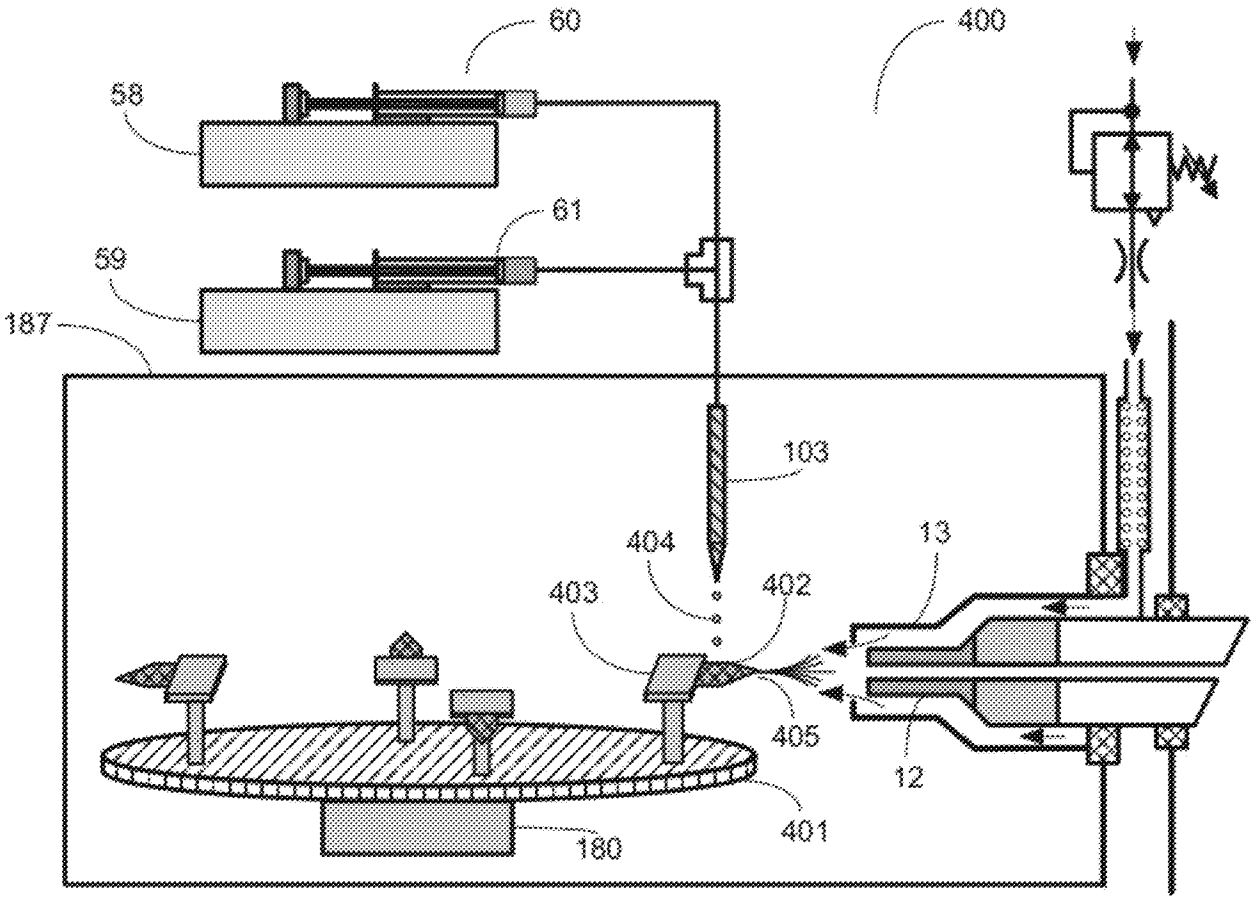
FIG. 21 is a front view of an embodiment of a DSA ion source that includes electrospray ionization from shaped solid sample support with a supply of liquid for electrospraying during analysis.

DSA ion source system 1 can be configured with means to generate sample ions without the need for reagent ion generator 2. Referring to FIG. 21, modified DSA ion source 400 includes fluid delivery needle 103, sample holder assembly connected to four axis translator assembly 180, paper or polymer sample sprayers 402 with sample spotted on each sprayer, sample sprayer holder 403, syringe pumps 58 and 59 configured with syringes 60 and 61 respectively and nose piece 13 with capillary entrance electrode 12 as previously described above. Voltages applied to nose piece electrode 13 and capillary entrance electrode 12 sustain sample electrospray from each sprayer 402. Liquid drops 404 may be delivered from needle 103 to sample spotted sprayer 402 during electrospraying to move spotted sample toward the spraying tip 405 of sprayer 402. Fluid flow rate and solution composition delivered through needle 103 to sprayer 402 during electrospraying is controlled using syringe pumps 58 and 59 with syringes 60 and 61 respectively.

Figure 22:
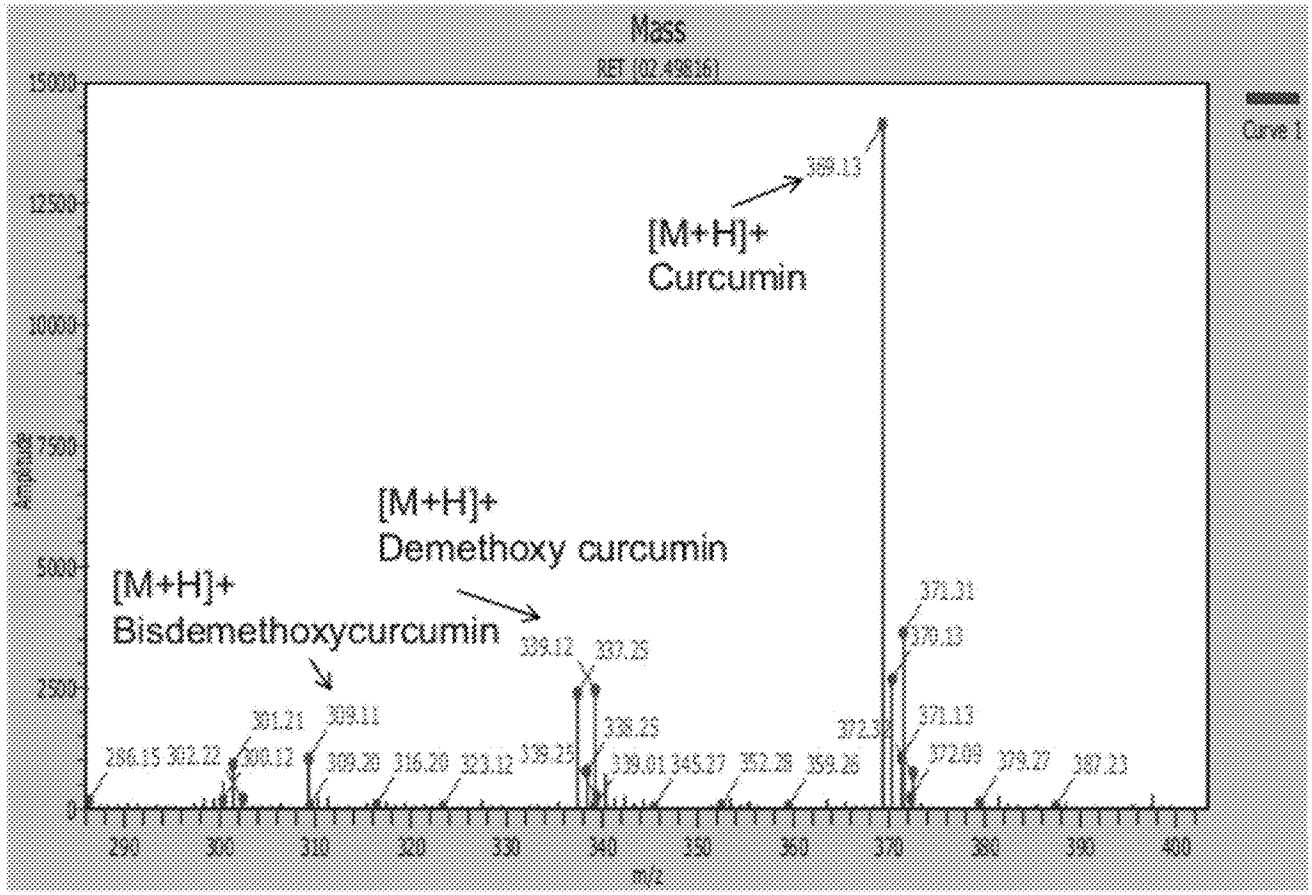
FIG. 22 is a mass spectrum of turmeric powder analyzed using an embodiment of a DSA ion source system.
Figure 23:
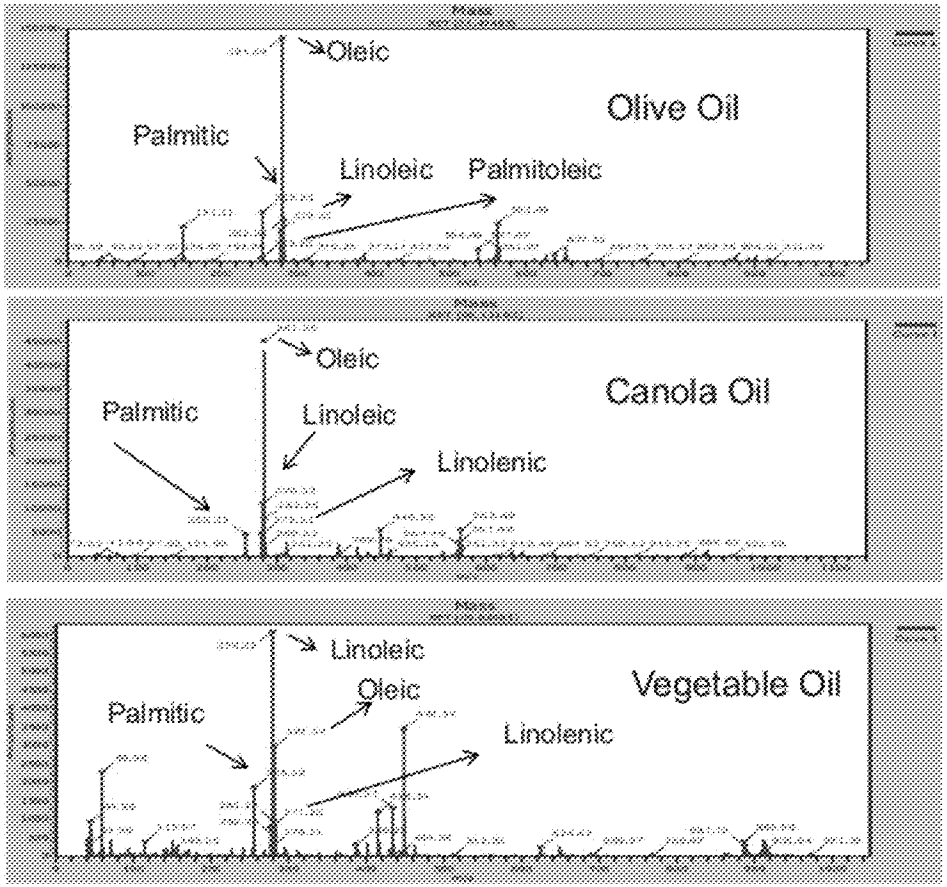
FIG. 23 shows three mass spectra of three different cooking oils analyzed with an embodiment of a DSA ion source system.
Figure 24:
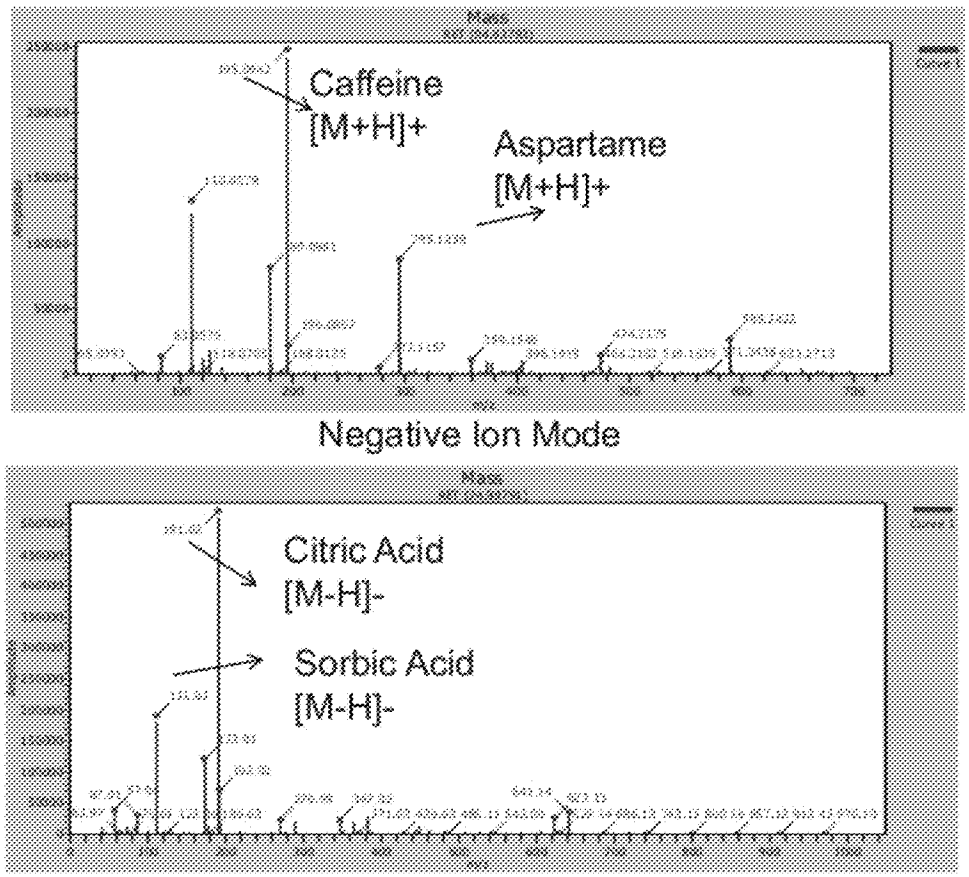
FIG. 24 shows positive and negative ion polarity mass spectra acquired from a sample of Diet Coke using an embodiment of a DSA ion source system.
Figure 25:
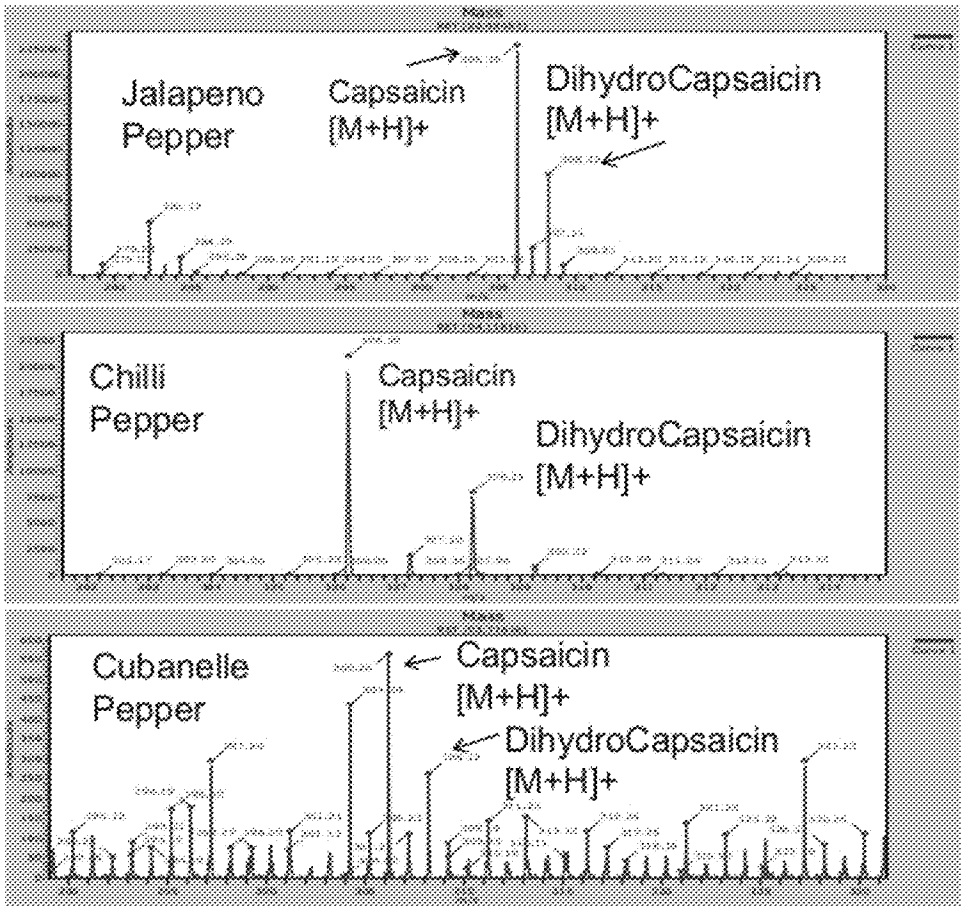
FIG. 25 shows three mass spectrum acquired from three different types of pepper samples using an embodiment of a DSA ion source system.

FIG. 22 shows a mass spectrum acquired in positive ion polarity mode when turmeric powder was heated in DSA ion source 1 using glass tube sample holders similar to sample tubes 382 shown in FIGS. 3, 16 and 20. FIG. 23 shows three mass spectra acquired in positive ion polarity mode from three samples of cooking oils run in DSA ion source 1. The liquid cooking oil was evaporated from the drawn down tips of glass tubes after the cooking oils were loaded by wicking up into the small glass tips. FIG. 24 shows mass spectra acquired in positive and negative ion polarity mode of Diet Coke liquid samples run in DSA ion source 1 loaded onto mesh targets similar to mesh assembly 22 shown in FIG. 2. FIG. 25 show three mass spectra of solid chili pepper plant samples run with no sample workup in DSA ion source 1. The amplitude of the capsaicin peak height increases with the hotness of the pepper analyzed. Capsaicin is the primary component that makes peppers taste hot.

A number of embodiments of the invention have been described. Nevertheless, it will be understood that various modifications may be made without departing from the spirit and scope of the invention. Accordingly, other embodiments are within the scope of the following claims.

What is claimed is:

1. An apparatus for analysis of sample chemical species comprising:

an enclosure operating at approximately atmospheric pressure during operation of the apparatus;

a reagent ion or metastable species generator positioned in the enclosure, the reagent ion or metastable species generator comprising an element that produces a corona or glow discharge during operation of the apparatus to generate a reagent ion or metastable species, the reagent ion or metastable species generator comprises a gas inlet, a rotatable angled end, and a removable end piece, the rotatable angled end being configured to be arranged proximate to the at least one sample holder;

at least one seal configured to prevent gaseous exchange with ambient air during sample analysis within the enclosure;

a sample holder assembly mounted on a translation stage positioned in the enclosure, the sample holder assembly comprising at least one sample holder comprising a plurality of individual sample placement locations;

a chemical analyzer for detecting and analyzing an ionized sample chemical species during operation of the apparatus; and a capillary arranged to direct the ionized sample chemical species into the chemical analyzer, wherein during operation of the apparatus, the reagent ion or metastable species ionizes a sample chemical species positioned at a corresponding sample placement location to generate the ionized sample chemical species.

2. The apparatus of claim 1, wherein a gas or vapor flow path of the reagent ion or metastable species generator is configured to flow pass the element that produces the corona or glow discharge.

3. The apparatus of claim 1, further comprising an electrospray or pneumatic nebulizer assisted electrospray which produces charged liquid droplets.

4. The apparatus of claim 1, wherein the one or more sample chemical species comprise solid, liquid, or gas phase samples or emulsions or powder samples.

5. The apparatus of claim 1, further comprising a sample gas supply to introduce a sample gas flow through the reagent ion or metastable species generator.

6. The apparatus of claim 5, wherein during operation of the apparatus the sample gas flow passes the element that produces the corona or glow discharge during analysis.

7. The apparatus of claim 5, further comprising a purge gas manifold with gas flow control and a heated countercurrent drying gas with temperature and flow control.

8. The apparatus of claim 5, further comprising a nebulizing gas source with pressure control and an auxiliary gas flow with flow control.

9. The apparatus of claim 1, wherein the chemical analyzer comprises an element selected from the group consisting of mass-to-charge analyzer and an ion mobility analyzer.

10. The apparatus of claim 1, wherein the capillary further comprises an orifice having a voltage applied thereto during operation of the apparatus.

11. The apparatus of claim 1, wherein the reagent ions or metastable species generator comprises a pneumatic nebulizer and a heater.

12. The apparatus of claim 11, further comprising an inlet configured to receive a liquid sample, the liquid sample configured to be introduced into the pneumatic nebulizer and the heater.

13. The apparatus of claim 12, wherein during operation of the apparatus the liquid sample is converted to vapor and flows pass the element that produces the corona or glow discharge in the reagent ion or metastable species generator.

14. The apparatus of claim 1, wherein the translation stage comprises one or more multiple axis of motion and a rotational axis of motion for movement of the sample holder.

15. The apparatus of claim 1, further comprising a sealable sample introduction door or port through which the sample holder is introduced into the enclosure.

16. The apparatus of claim 1, wherein the vent port is configured to exhaust gas from the enclosure.

17. The apparatus of claim 16, further comprising at least one gas flow control, at least one gas heater and at least one temperature control.

18. The apparatus of claim 1, wherein the element that produces the corona or glow discharge is a corona discharge needle.

19. The apparatus of claim 1, wherein the plurality of individual sample placement locations are arranged in a two-dimensional array.

20. The apparatus of claim 1, wherein the sample holder assembly comprises a plurality of sample holders.

21. The apparatus of claim 20, wherein two of the plurality of sample holders are arranged in intersecting planes.

22. The apparatus of claim 1, further comprising a position sensor for the at least one sample holder, wherein during operation of the apparatus, the position sensor provides feedback to allow automated and optimized positioning of the reagent ion or metastable species generator relative to the at least one sample holder.

23. The apparatus of claim 1, wherein the sample chemical species comprises a grounded sample held in the sample holder.

24. The apparatus of claim 1, further comprising a heating source configured to apply controlled heating or heat gradient to a sample surface of the at least one sample holder to cause a separation in time or temperature of different sample components leaving the sample surface.

25. The apparatus of claim 24, further comprising a temperature sensor to monitor a temperature of the sample surface.

26. The apparatus of claim 24, further comprising a video camera to visualize an appearance of the sample surface.

27. The apparatus of claim 1, wherein the at least one sample holder comprises mesh targets configured to hold liquid samples.

28. The apparatus of claim 1, wherein the corona discharge comprises a glow discharge.

* * * * *